US010766263B2

(12) United States Patent
Onishi

(10) Patent No.: US 10,766,263 B2
(45) Date of Patent: Sep. 8, 2020

(54) MAINTENANCE UNIT AND INK-JET RECORDING APPARATUS THEREWITH

(71) Applicant: KYOCERA Document Solutions Inc., Osaka (JP)

(72) Inventor: Yuzo Onishi, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 16/675,962

(22) Filed: Nov. 6, 2019

(65) Prior Publication Data

US 2020/0156379 A1 May 21, 2020

(30) Foreign Application Priority Data

Nov. 15, 2018 (JP) ..... 2018-214526

(51) Int. Cl.
*B41J 2/165* (2006.01)

(52) U.S. Cl.
CPC ..... *B41J 2/16535* (2013.01)

(58) Field of Classification Search
CPC ..... B41J 2/16535; B41J 2/16547; B41J 2/16544; B41J 2/16511; B41J 2/16538; B41J 2/16508; B41J 2002/16591; B41J 2/16585
See application file for complete search history.

(56) References Cited

U.S. PATENT DOCUMENTS

2002/0015070 A1* 2/2002 Taylor ..... B41J 2/16547 347/32
2018/0207936 A1 7/2018 Satake et al.

FOREIGN PATENT DOCUMENTS

JP 2018-118441 A 8/2018

* cited by examiner

*Primary Examiner* — Huan H Tran
(74) *Attorney, Agent, or Firm* — Stein IP, LLC

(57) ABSTRACT

A maintenance unit includes a wiper for wiping off ink on a recording head and a wiper carriage. A holding metal plate holds the wiper and includes a communication portion which connects together an upper space and a lower space. The communication portion has an ink guide member. The ink guide member has an upper opening and a lower opening. The length of the upper opening in the direction perpendicular to the wiping direction is larger than the length of an ink ejection face. The length of the communication portion is smaller than the length of the ink ejection face.

8 Claims, 13 Drawing Sheets

MAINTENANCE UNIT AND INK-JET RECORDING APPARATUS THEREWITH

INCORPORATION BY REFERENCE

This application is based upon and claims the benefit of priority from the corresponding Japanese Patent Application No. 2018-214526 filed on Nov. 15, 2018, the contents of which are hereby incorporated by reference.

BACKGROUND

The present disclosure relates to a maintenance unit for cleaning a recording head which ejects ink on a recording medium such as a sheet. The present disclosure relates to an ink-jet recording apparatus provided with a maintenance unit.

Recording apparatuses include, for example, facsimile machines, copiers, and printers. Ink-jet recording apparatuses, which form images by ejecting ink, can form high-definition images. Ink-jet recording apparatuses are widely used.

In conventional ink-jet recording apparatuses, recovery operation is usually performed. Recovery operation is an operation in which thickened ink in an ink ejection opening of a recording head is forcibly pushed out and the pushed-out ink is wiped off by a wiper. In some known ink-jet recording apparatuses, recovery operation of the recording head is performed using a maintenance unit.

The maintenance unit, for example, includes a wiper, a wiper carriage, and a collection tray. The wiper wipes off ink pushed out forcibly. The wiper carriage, while holding the wiper, moves along the wiping direction. The collection tray is arranged under the wiper and collects ink wiped off by the wiper. Some wiper carriages are provided with a holding plate for holding the wiper.

In a conventional maintenance unit, ink fallen from an ink ejection face can attach to the holding plate. When a large amount of ink is pushed out of the ink ejection face, ink tends to attach to the holding plate. The ink attached to the holding plate can coagulate on the holding plate. The ink attached to the holding plate can flow to an end part of the wiper carriage to affect the reciprocating movement of the wiper carriage. However, if an opening portion (an opening for guiding ink to the collection tray) in the holding plate is made larger for preventing ink from attaching to the holding plate, the strength of the holding plate is degraded.

SUMMARY

A maintenance unit according to one aspect of the present disclosure is a maintenance unit that cleans a recording head having an ink ejection face in which ink ejection openings for ejecting ink onto a recording medium are open. The maintenance unit includes a wiper for wiping off ink pushed out forcibly from the ink ejection face, a wiper carriage which, while holding the wiper, moves along the wiping direction, and a collection tray which is arranged under the wiper and has a tray face for collecting ink wiped off by the wiper. The wiper carriage has a holding plate for holding the wiper. In a part of the holding plate facing the ink ejection face, a communication portion which connects together an upper space and a lower space is formed. The communication portion is provided with an ink guide member having an upper opening which receives ink fallen from the ink ejection face when ink is pushed out forcibly from the ink ejection face, and a lower opening which is connected to the upper opening and makes ink fall on the collection tray. The length of the upper opening in the orthogonal direction perpendicular to the wiping direction is larger than the length of the ink ejection face in the orthogonal direction, and the length of the communication portion in the orthogonal direction is smaller than the length of the ink ejection face in the orthogonal direction, and the length of the lower opening in the orthogonal direction is smaller than the length of the communication portion in the orthogonal direction.

This and other objects of the present disclosure, and the specific benefits obtained according to the present disclosure, will become apparent from the description of embodiments which follows.

DETAILED DESCRIPTION

The present disclosure is aimed at preventing, in a maintenance unit, adhesion of ink to a holding plate while suppressing degradation of strength of the holding plate. Hereinafter, an embodiment of the present disclosure will be described with reference to the accompanying drawings.

Figure 1:
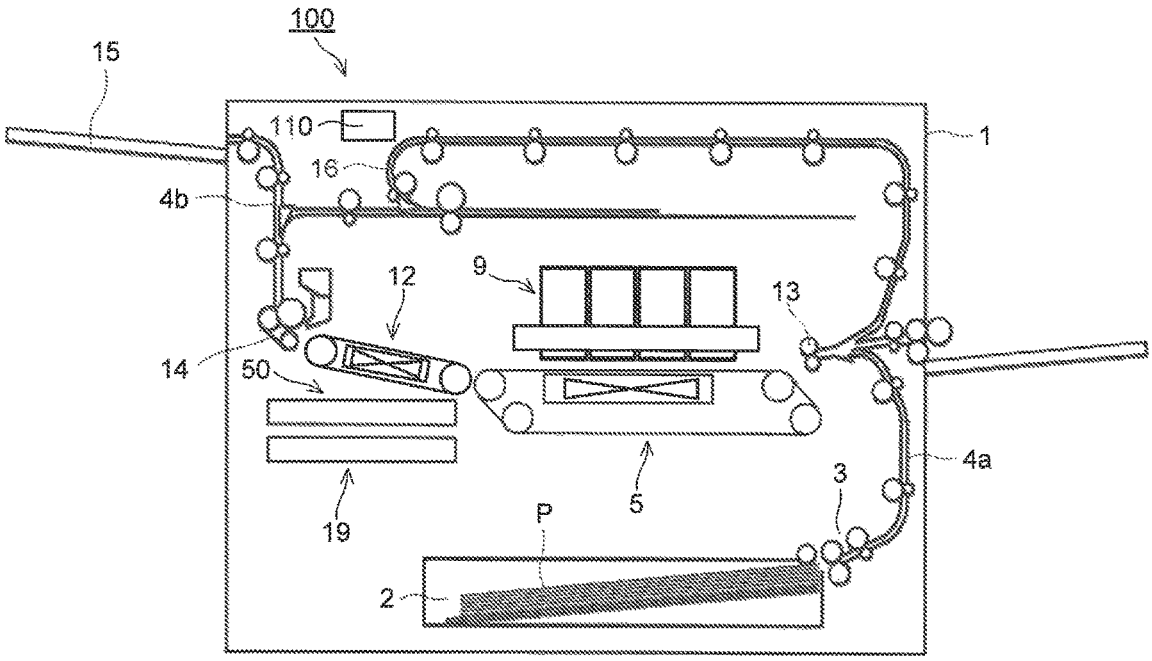
FIG. 1 is a diagram showing one example of a printer provided with a maintenance unit according to one embodiment of the present disclosure.

With reference to FIGS. 1 to 24, an ink-jet printer 100 (ink-jet recording apparatus) according to one embodiment of the present disclosure will be described. The printer 100 includes a maintenance unit 19. As shown in FIG. 1, a sheet feeding cassette 2 (a sheet storage portion) is arranged in a lower part inside a printer main body 1. Sheets P (one example of a recording medium) are stored inside the sheet feeding cassette 2. A sheet feeding device 3 is arranged on the downstream side of the sheet feeding cassette 2 in the sheet conveying direction (on the upper right side of the sheet feeding cassette 2 in FIG. 1). The sheet feeding device 3 feeds out sheets P one after another separately to the upper right of the sheet feeding cassette 2 in FIG. 1.

The printer 100 has a first sheet conveying passage 4*a* inside. The first sheet conveying passage 4*a* is located in the sheet feeding direction (to the upper right) of the sheet feeding cassette 2. The first sheet conveying passage 4*a* conveys a sheet P fed out from the sheet feeding cassette 2 vertically upward along a side face of the printer main body 1.

A registration roller pair 13 is provided at the downstream end of the first sheet conveying passage 4*a* in the sheet conveying direction. A first conveying unit 5 and a recording portion 9 are arranged close to a downstream-side part of the registration roller pair 13 in the sheet conveying direction. A sheet P fed out of the sheet feeding cassette 2 reaches the registration roller pair 13 via the first sheet conveying passage 4*a*. The registration roller pair 13 corrects skewed feeding of the sheet P. After correction, the registration roller pair 13 feeds out the sheet P toward the first conveying unit 5 in coordination with the timing of ink ejecting operation by the recording portion 9.

A second conveying unit 12 is arranged on the downstream side (the left side in FIG. 1) of the first conveying unit 5 in the sheet conveying direction. A sheet P having an ink image recorded on it at the recording portion 9 is conveyed to the second conveying unit 12. The second conveying unit 12, while conveying the sheet, dries the ink on the surface of the sheet P.

A decurler portion 14 is provided on the downstream side of the second conveying unit 12 in the sheet conveying direction. The decurler portion 14 is provided near the left side face of the printer main body 1 shown in FIG. 1. The sheet P with the ink dried at the second conveying unit 12 is conveyed to the decurler portion 14. The decurler portion 14 straightens the curl of the sheet P.

A second sheet conveying passage 4*b* is arranged on the downstream side of (above in FIG. 1) the decurler portion 14 in the sheet conveying direction. When no double-sided recording is performed, the second sheet conveying passage 4*b* discharges the sheet P that has passed through the decurler portion 14 onto a sheet discharge tray 15. The sheet discharge tray 15 is arranged outside, at the left side of, the printer 100 shown in FIG. 1.

A reversing conveying passage 16 for double-sided recording is provided above the recording portion 9 and the second conveying unit 12. When double-sided recording is performed, the sheet P having been recorded on its first side and having passed through the second conveying unit 12 and the decurler portion 14 is conveyed via the second sheet conveying passage 4*b* to the reversing conveying passage 16. The sheet P conveyed to the reversing conveying passage 16 has its conveying direction switched for recording on the second side. The sheet P is conveyed rightward in FIG. 1 in the reversing conveying passage 16. The sheet P passes back into the first sheet conveying passage 4*a*. The sheet P is conveyed via the registration roller pair 13 to the first conveying unit 5 again with the second side up.

The maintenance unit 19 and a cap unit 50 are arranged below the second conveying unit 12. During purging (details will be given later), the maintenance unit 19 moves horizontally to under the recording portion 9. The maintenance unit 19 wipes off ink pushed out of ink ejection openings in recording heads. The maintenance unit 19 collects ink wiped off. When capping the ink ejection faces of the recording heads, the cap unit 50 horizontally moves to under the recording portion 9. Then, the cap unit 50 moves upward to be attached to the bottom faces of the recording heads.

Figure 2:
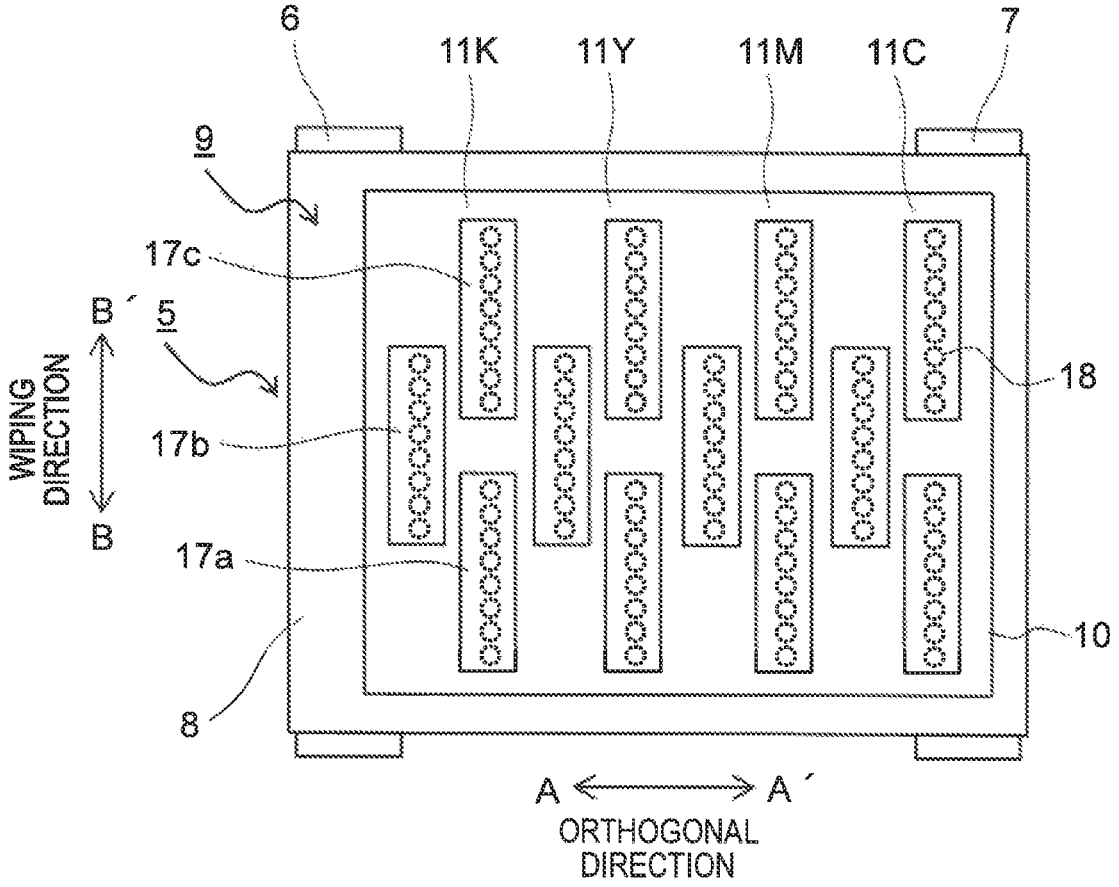
FIG. 2 is a diagram showing a first conveying unit and a recording portion in the printer according to the one embodiment of the present disclosure, as seen from above.
Figure 3:
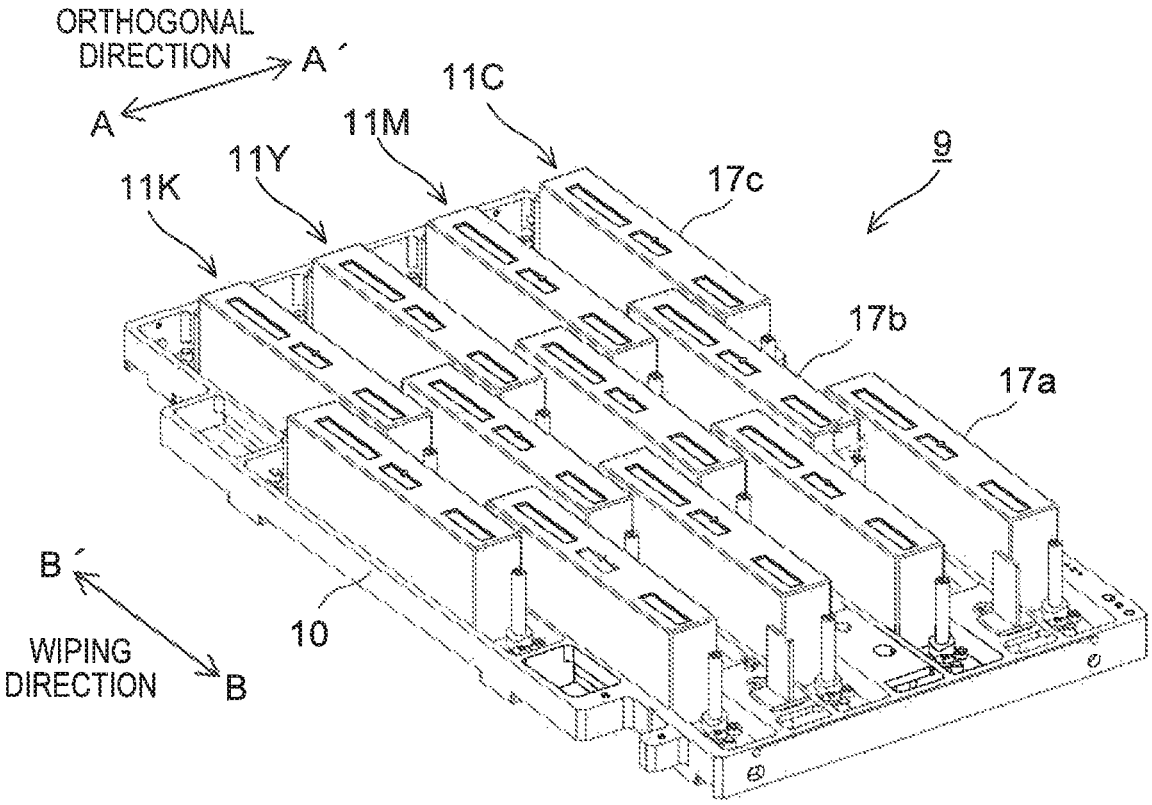
FIG. 3 is a diagram showing one example of a structure of the recording portion in the printer according to the one embodiment of the present disclosure.

As shown in FIGS. 2 and 3, the recording portion 9 includes a head housing 10 and line heads 11C, 11M, 11Y and 11K, These line heads 11C to 11K are held by the head housing 10. The first conveying unit 5 includes a driving roller, a plurality of driven rollers, and a first conveying belt. The first conveying belt is stretched around these rollers. The line heads 11C to 11K are supported at such a height as to leave a predetermined clearance (for example, 1 mm) between the ink ejection openings and the conveying face of the first conveying belt. For each line head 11, a plurality of (here, three) recording heads 17*a* to 17*c* are arranged in a staggered manner along the sheet orthogonal direction (the direction perpendicular to the sheet conveying direction). In FIG. 2 and the following relevant diagrams, the direction A indicates the sheet conveying direction. In FIG. 2 and the following relevant diagrams, the sheet orthogonal direction (the direction perpendicular to the sheet conveying direction) is indicated by arrows BB'.

Figure 4:
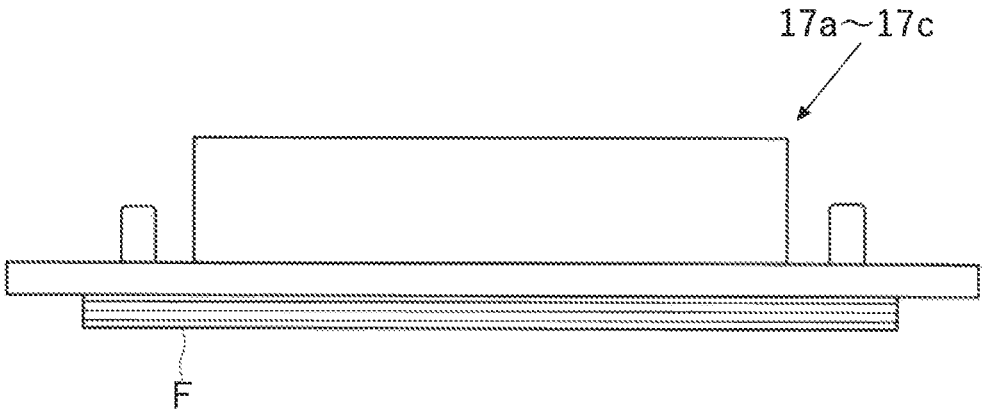
FIG. 4 is a diagram showing one example of a structure of a recording head constituting a line head according to the one embodiment of the present disclosure.
Figure 5:
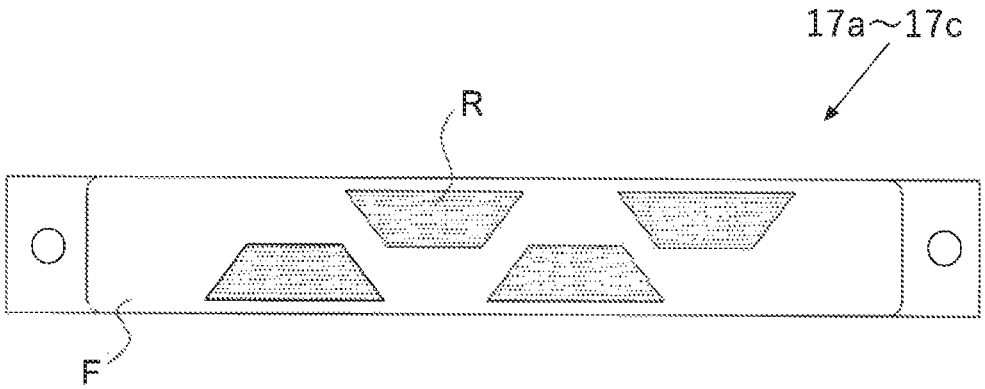
FIG. 5 is a diagram showing one example of the recording head according to the one embodiment of the present disclosure, as seen from the ink ejection face-side.

As shown in FIGS. 4 and 5, the recording heads 17*a* to 17*c* include ink ejection faces F. The bottom faces of the recording heads 17*a* to 17*c* are the ink ejection faces F. The ink ejection face F has an ink ejection region R. A large number of ink ejection openings 18 (see FIG. 2) are arrayed in the ink ejection region R. The recording heads 17*a* to 17*c* have the same shape and structure. The recording head shown in FIGS. 4 and 5 can be any of the recording heads 17*a*, 17*b*, and 17*c*.

The recording heads 17*a* to 17*c* constituting the line heads 11C to 11K are fed with ink. The line heads 11C to 11K are fed with ink of different colors (cyan, magenta, yellow, and black) corresponding to them. An ink tank (unillustrated) that stores and feeds ink is provided for each color.

A control portion 110 (see FIG. 1) which controls the whole printer 100 is provided. The control portion 110 transmits a control signal corresponding to image data received from an external computer or the like. A sheet P is conveyed while being held by suction on the conveying face of the first conveying belt. The recording heads 17*a* to 17*c*, based on a control signal from the control portion 110, eject ink from the ink ejection openings 18 onto a sheet. A color image having ink of four colors, namely cyan, magenta, yellow and black, overlaid together is formed on the sheet P.

To prepare for the subsequent printing, the printer 100 cleans the ink ejection faces F of the recording heads 17*a* to 17*c* at the start of printing after a long out-of-operation period and at intermissions during printing. In cleaning, ink is forcibly discharged from the ink ejection openings 18 of all the recording heads 17*a* to 17*c* and the ink ejection faces F are wiped using wipers 35*a* to 35*c* (see FIG. 12, details will be given later).

Next, the cap unit 50, the maintenance unit 19, and the structure around them will be described in detail.

Figure 6:
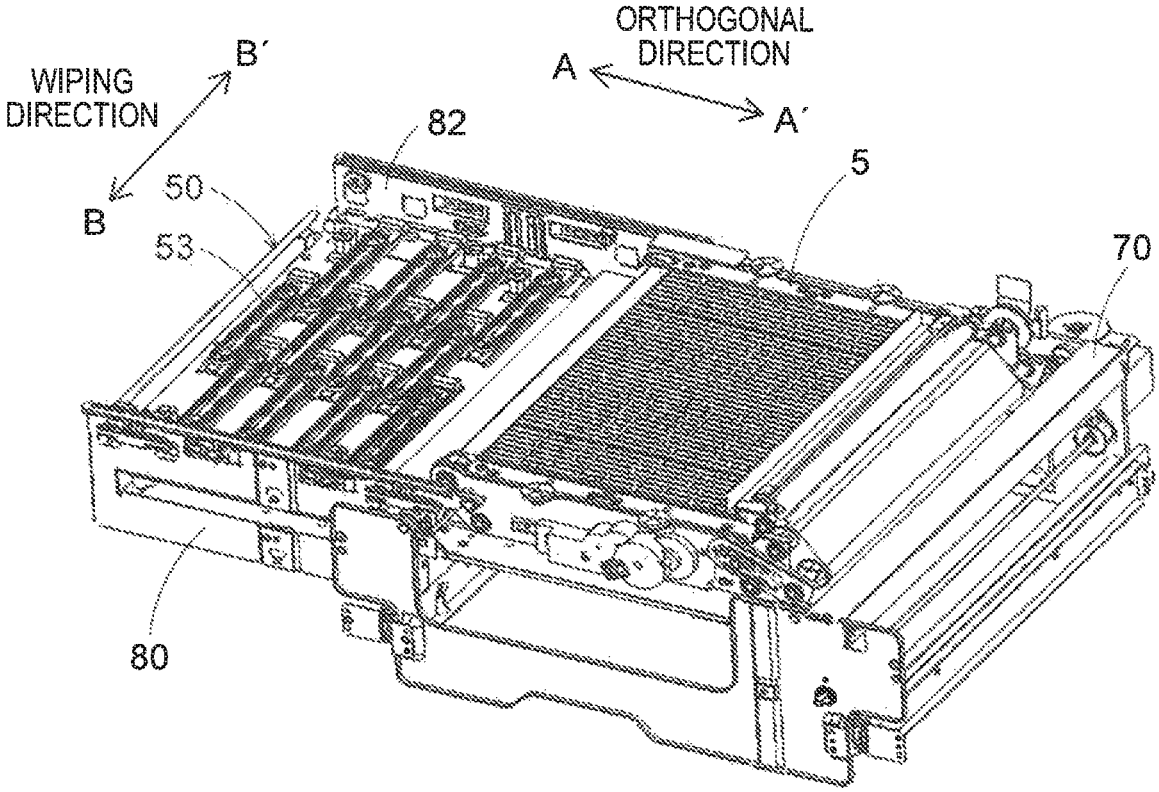
FIG. 6 is a diagram showing one example of a structure of a cap unit, the first conveying unit, and the like in the printer according to the one embodiment of the present disclosure in a state where the first conveying unit is arranged in a raised position.
Figure 7:
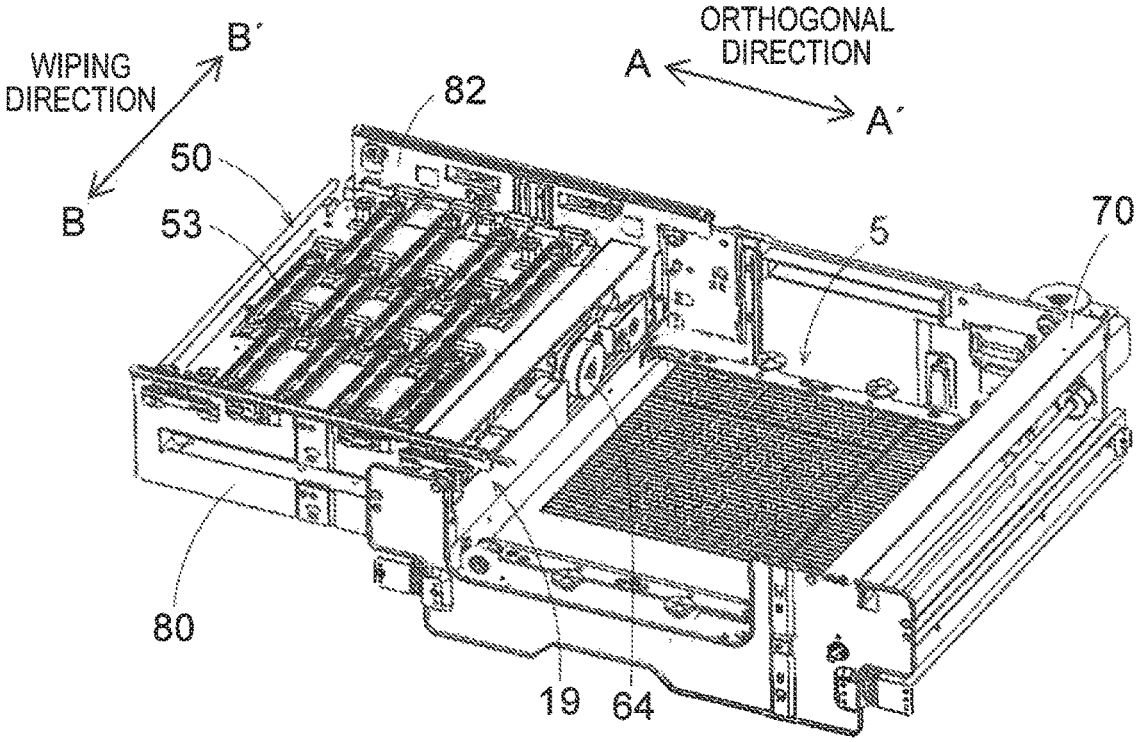
FIG. 7 is a diagram showing one example of the structure of the cap unit, the first conveying unit, and the like in the printer according to the one embodiment of the present disclosure in a state where the first conveying unit is arranged in a lowered position.

As shown in FIGS. 6 and 7, the first conveying unit 5 is housed in a housing frame 70. The first conveying unit 5 is configured to be ascendable/descendable in the up-down direction by the action of a conveying lift mechanism (unillustrated). The conveying lift mechanism includes a lifting drive source and a gear train. During printing, the first conveying unit 5 is arranged in a raised position (the position in FIG. 6). In the lifted position, the first conveying unit 5 moves close to the ink ejection faces F of the recording heads 17*a* to 17*c*. During recovery operation (details will be given later) and capping operation of the recording heads 17*a* to 17*c*, the first conveying unit 5 is arranged in a lowered position (the position in FIG. 7).

Figure 8:
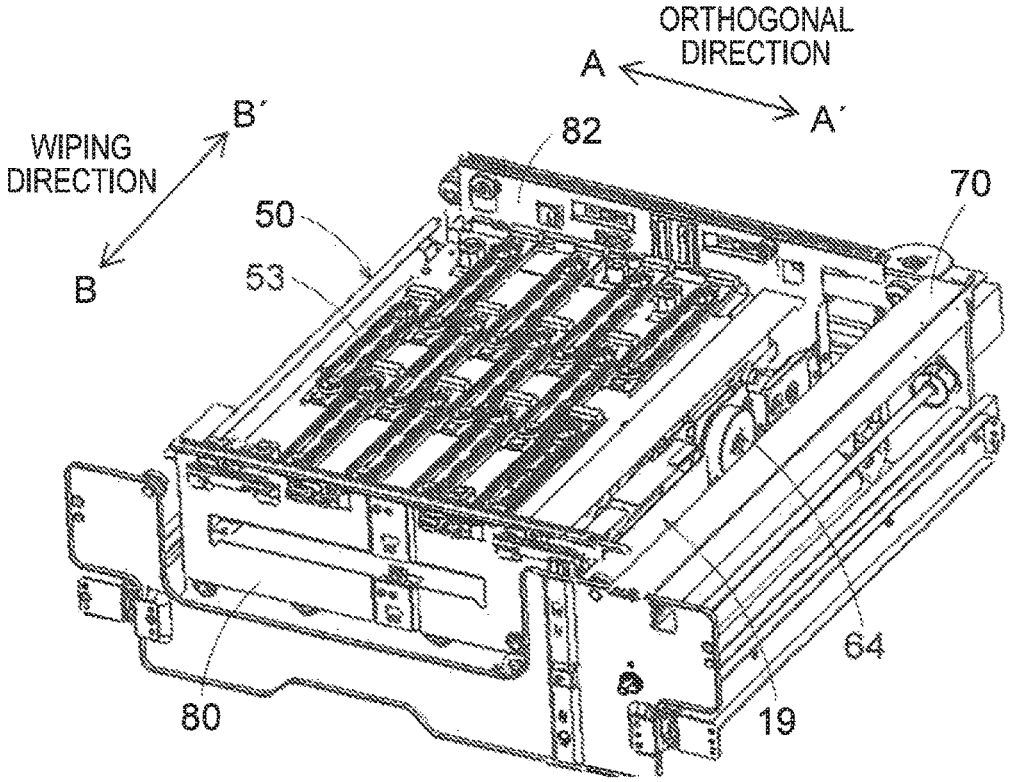
FIG. 8 is a diagram showing one example of the structure of the cap unit and the like in the printer according to the one embodiment of the present disclosure in a state where the cap unit and the maintenance unit are arranged in a first position.
Figure 9:
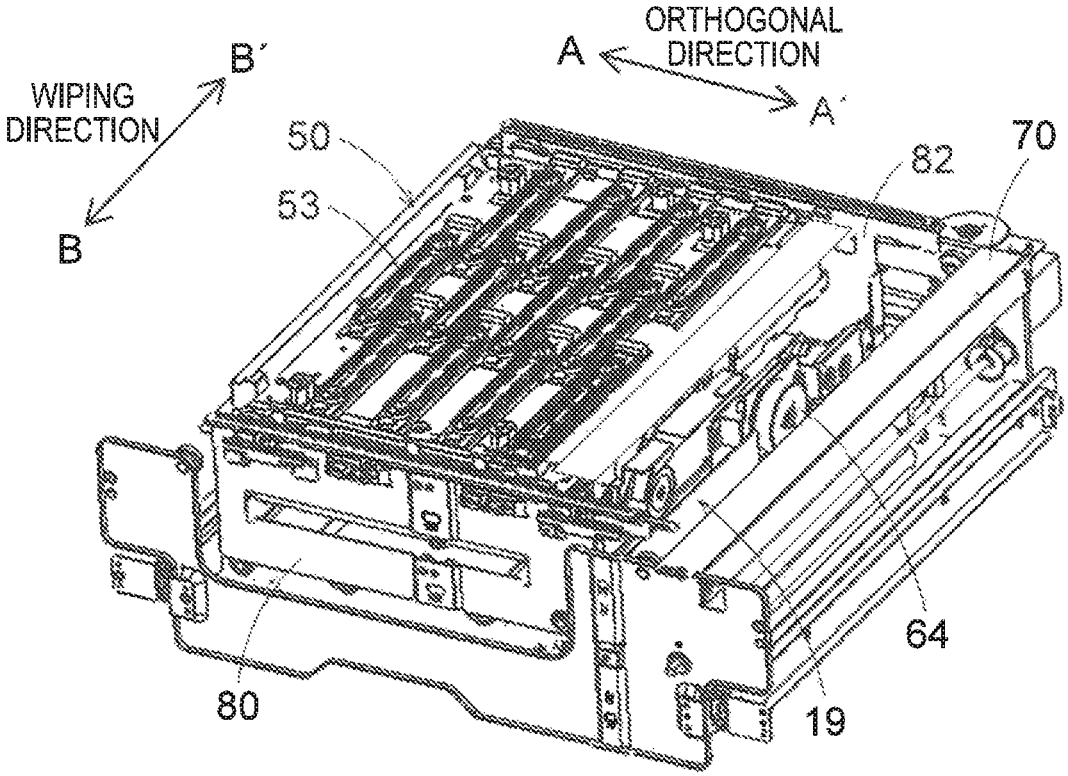
FIG. 9 is a diagram showing a state where the cap unit and the maintenance unit are raised from the state in FIG. 8.

As shown in FIGS. 7 and 8, the cap unit 50 is configured to be reciprocatable between a first position (the position in FIG. 8) and a second position (the position in FIG. 7). The first position is right under the recording portion 9. The second position is a position retracted from the first position in the horizontal direction (arrow A direction). When the cap unit 50 is arranged in the first position, the first conveying unit 5 is arranged in the lowered position. As shown in FIGS. 8 and 9, the cap unit 50 is configured to be ascendable/descendable in the up-down direction in the first position.

During printing and recovery operation, the cap unit 50 is arranged in the second position (the position in FIG. 6). The cap unit 50 is so configured that, during capping operation, it moves to the first position (the position in FIGS. 8 and 9) and then up to cover the ink ejection faces F of the recording heads 17*a* to 17*c* with the cap portions 53. The cap unit 50 is so configured that, in the second position, it is coupleable/decouplable to and from the maintenance unit 19 (details will be given later). The cap unit 50 moves in the horizontal and up-down directions with the maintenance unit 19 coupled with the cap unit 50.

Figure 10:
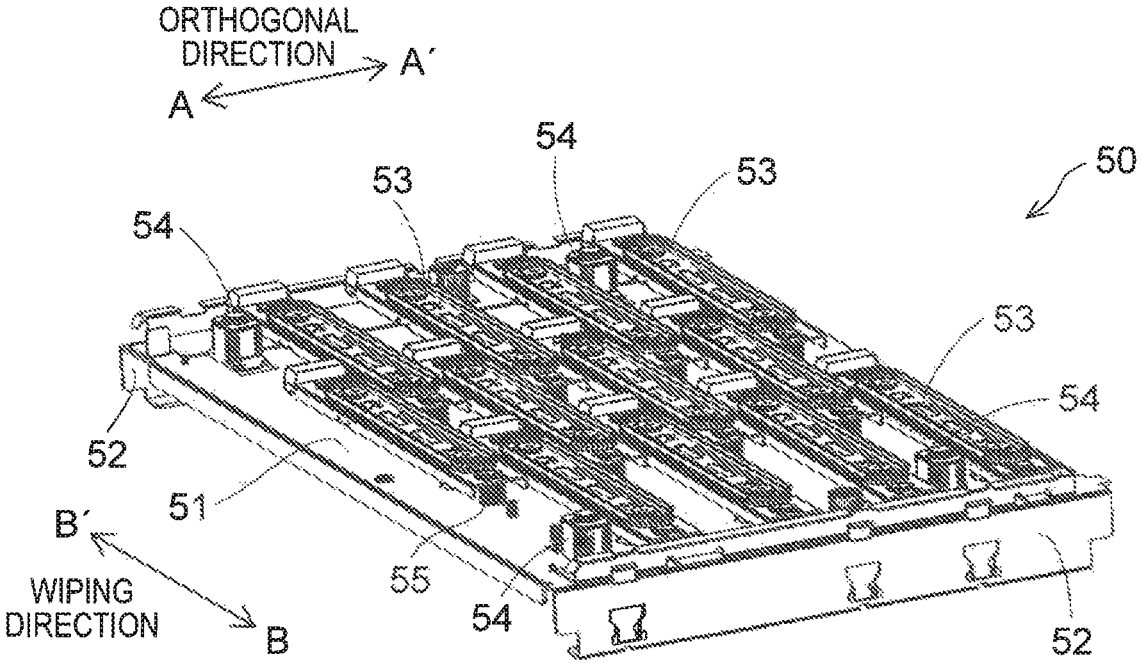
FIG. 10 is a diagram showing one example of the structure of the cap unit in the printer according to the one embodiment of the present disclosure.

As shown in FIG. 10, the cap unit 50 includes a cap tray 51, a pair of tray side plates 52, cap portions 53, and height-direction positioning projections 54. The cap tray 51 is made of sheet metal. The pair of tray side plates 52 is formed at opposite ends of the cap tray 51 in the arrow BB' direction (wiping direction). The cap portions 53 comprise 12 of them; these are arranged on the top face of the cap tray 51, and have depressed sections as seen from the orthogonal direction. The height-direction positioning projections 54 comprise four of them.

The cap portions 53 are arranged at the positions corresponding to the recording heads 17*a* to 17*c*. As shown in FIG. 9, when the cap unit 50 in the first direction moves upward, the ink ejection faces F of the recording heads 17*a* to 17*c* fit in the cap portions 53. When the cap unit 50 is raised toward the recording portion 9, the height-direction positioning projections 54 make contact with the housing 10 of the recording portion 9. This determines the position of the cap tray 51 in the height direction. Between bottom parts of both ends of the cap portions 53 in their longitudinal direction (arrow BB' direction, wiping direction) and the cap tray 51, a cap spring 55 is arranged. The cap spring 55 comprises a compression spring. The cap spring 55 serves to keep constant the pressure of contact between the cap portions 53 and the ink ejection face F.

Figure 11:
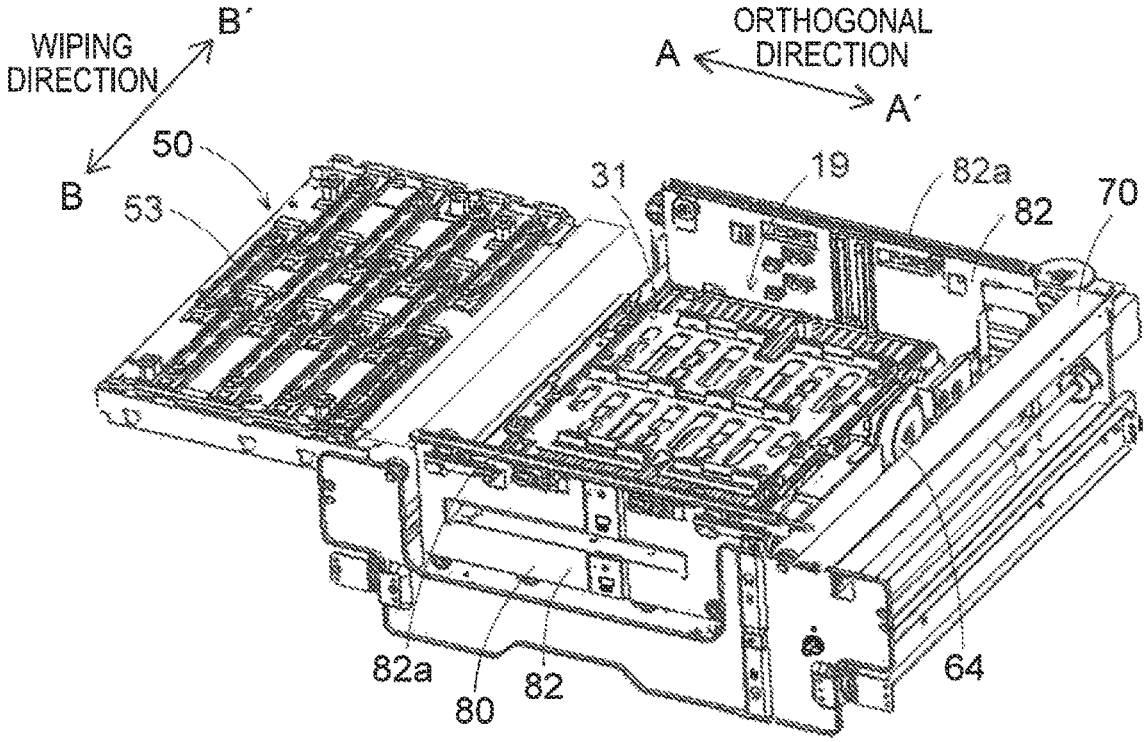
FIG. 11 is a diagram showing one example of the structure of the cap unit, the maintenance unit, and the like in the printer according to the one embodiment of the present disclosure in a state where the cap unit is arranged in a second position and the maintenance unit is arranged in the first position.
Figure 12:
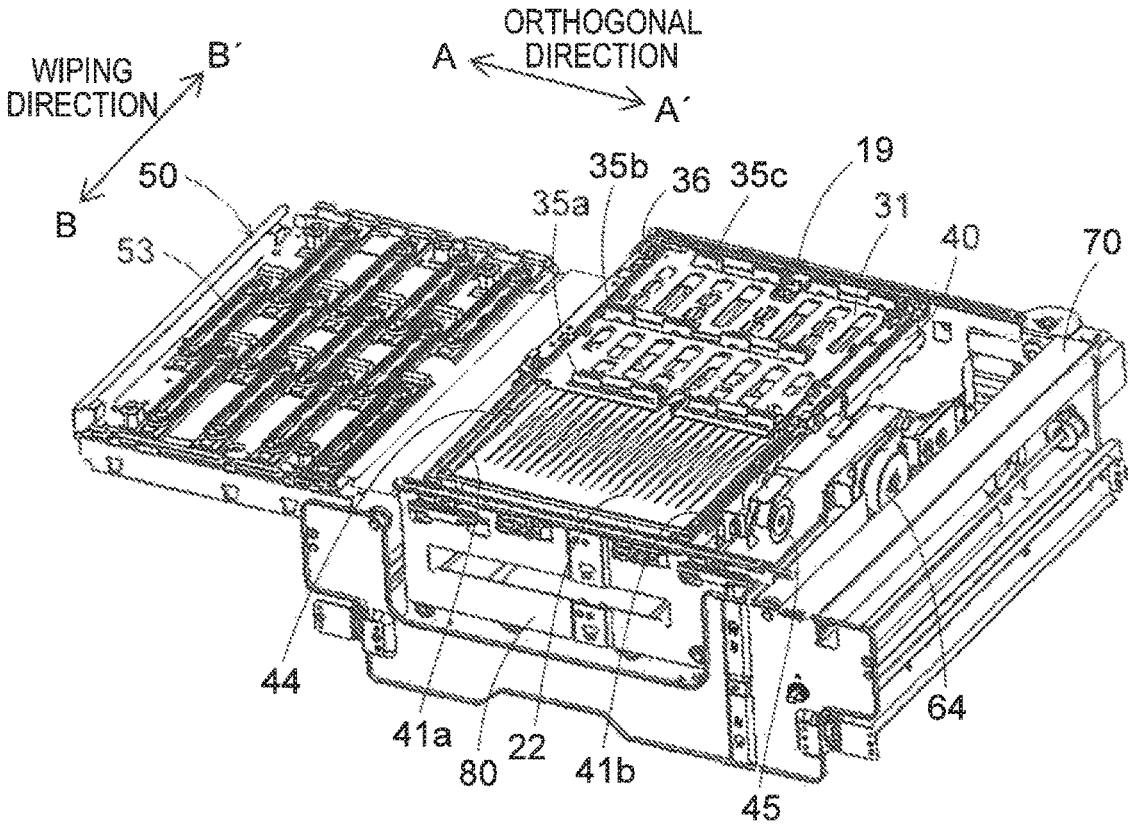
FIG. 12 is a diagram showing a state where the maintenance unit is raised from the state in FIG. 11.

As shown in FIGS. 7 and 11, the maintenance unit 19 is configured to be reciprocatable between the first position (the position in FIG. 11) and the second position (the position in FIG. 7). The first position is right under the recording portion 9. The second position is a position retracted from the first position in the horizontal direction (arrow A direction). When the maintenance unit 19 is arranged in the first position, the first conveying unit 5 is arranged in the lowered position. As shown in FIGS. 11 and 12, the maintenance unit 19 is configured to be ascendable/descendable in the up-down direction in the first position.

During printing, the maintenance unit 19 is arranged in the second position. The maintenance unit 19 is so configured that, during recovery and capping operation, it moves up in the first position (position in FIG. 11).

Figure 13:
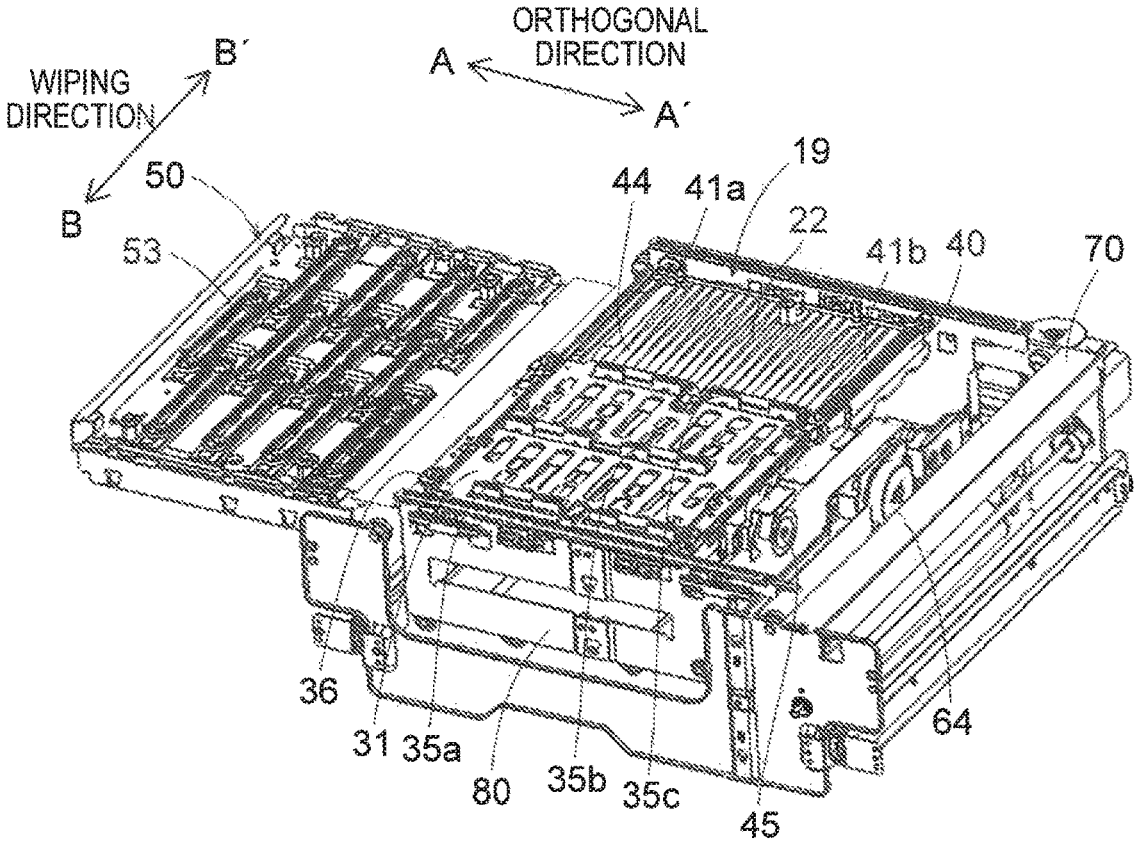
FIG. 13 is a diagram showing a state where a wiper carriage is moved from the state in FIG. 12 in the arrow B direction.

As shown in FIGS. 12 and 13, the maintenance unit 19 includes a wiper carriage 31 and a supporting frame 40. The wiper carriage 31 is substantially in a rectangular shape. A plurality of wipers 35*a* to 35*c* are fixed to the wiper carriage 31. The supporting frame 40 supports the wiper carriage 31.

Rail portions 41*a* and 41*b* are formed on the opposite edges of the top face of the supporting frame 40 in the arrow AA' direction (orthogonal direction). Rollers 36 provided at the four corners of the wiper carriage 31 make contact with rail portions 41*a* and 41*b*. The wiper carriage 31 is supported so as to be movable inside the supporting frame 40 in the arrow BB' direction (wiping direction).

To the outside of the supporting frame 40, a wiper carriage moving motor 45 and a gear train (unillustrated) are fitted. The wiper carriage moving motor 45 is a motor for moving the wiper carriage 31 horizontally (in the arrow BB' direction). One gear in the gear trains meshes with rack teeth (unillustrated) on the wiper carriage 31. As the wiper carriage moving motor 45 rotates forward and backward, the gear train rotates forward and backward. In accordance with the rotation, the wiper carriage 31 reciprocates horizontally (in the arrow BB' direction).

The wipers 35*a* to 35*c* scrape the ink ejection openings 18 of each of the recording heads 17*a* to 17*c*. The wipers 35*a* to 35*c* wipe ink pushed out of the ink ejection openings 18. The wipers 35*a* to 35*c* are elastic members (blades). The wipers 35*a* to 35*c* are, for example, members made of rubber such as EPDM. The wipers 35*a* to 35*c* are pressed into contact with the ink ejection faces F at wiping start positions outside the ink ejection regions R (see FIG. 5). As the wiper carriage 31 moves, the wipers 35*a* to 35*c*, while wiping the ink ejection face F, move in a predetermined direction (the arrow B direction in FIG. 12, the opposite direction of the wiping direction). The wipers 35*a* wipe the ink ejection face F of the recording head 17*a*, The wipers 35*b* wipe the ink ejection face F of the recording head 17*b*. The wipers 35*c* wipe the ink ejection face F of the recording head 17*c*.

Four wipers 35*a* are arranged at substantially equal intervals in the sheet conveying direction. Likewise, also four wipers 35*b* and four wipers 35*c* are arranged at substantially equal intervals in the sheet conveying direction. The line heads 11C to 11K each include the recording heads 17*a*, 17*b* and 17*c*. For each of the recording heads 17*a* (see FIG. 3), one wiper 35*a* is arranged at a position corresponding to the recording head 17*a*, For each of the recording heads 17*b* (see FIG. 3), one wiper 35*b* is arranged at a position corresponding to the recording head 17*b*. Each of the wipers 35*b* is fixed deviated by a predetermined distance with respect to the wipers 35*a* and 35*c* in the direction (arrow AA' direction) perpendicular to the moving direction (wiping direction) of the wiper carriage 31. For each of the recording heads 17*c* (see FIG. 3), one wiper 35*c* is arranged at a position corresponding to the recording head 17*c*.

A collection tray 44 is arranged on the top face of the supporting frame 40. The collection tray 44 is arranged under the wiper carriage 31. The ink collection tray 44 collects waste ink wiped off the ink ejection faces F by the wipers 35*a* to 35*c*. The waste ink collected in the collection tray 44 is stored in a waste ink tank (unillustrated). The structure around the collection tray 44 will be described in detail later.

As shown in FIG. 7, the maintenance unit 19 is housed in a carriage 80. In the second position, the maintenance unit 19 is arranged below the cap unit 50. As shown in FIGS. 7 and 11, when moving horizontally (in the arrow AA' direction), the maintenance unit 19 moves together with the carriage 80. As shown in FIGS. 11 and 12, when moving in the up-down direction, the maintenance unit 19 moves in the up-down direction with respect to the carriage 80.

Figure 14:
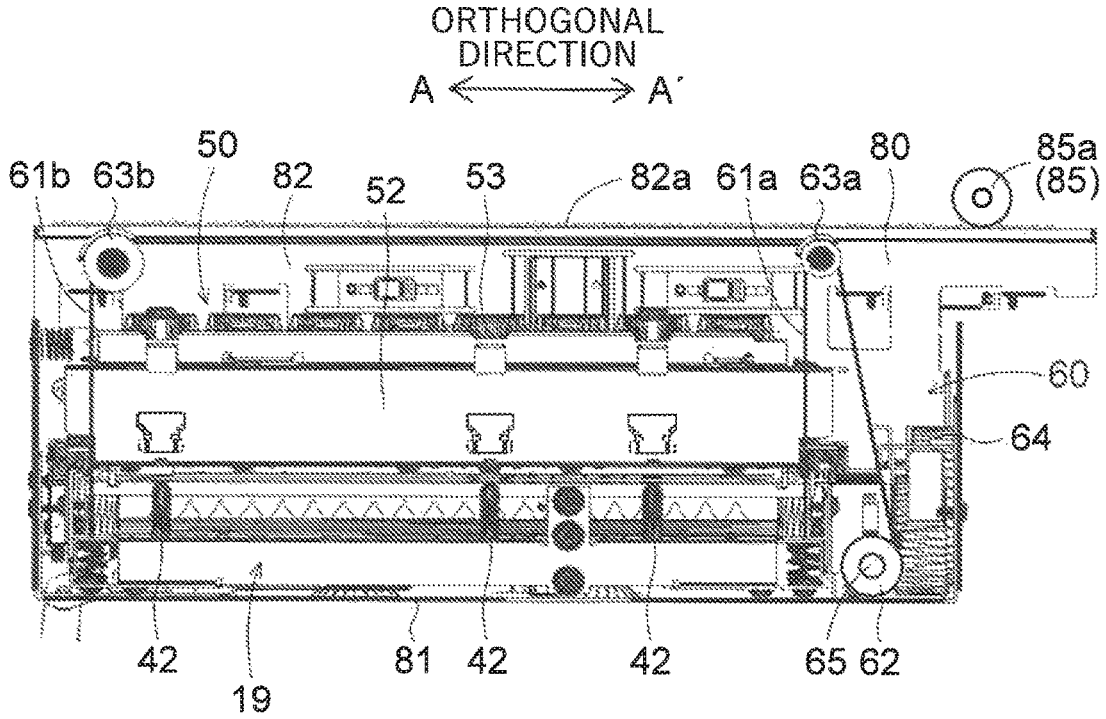
FIG. 14 is a diagram showing one example of a structure of and around a unit lift mechanism in the printer according to the one embodiment of the present disclosure.

The carriage 80 includes a carriage bottom plate 81 (see FIG. 14) made of sheet metal and a pair of carriage side plates 82. The maintenance unit 19 is placed on the carriage bottom plate 81 (see FIG. 14). A pair of carriage side plates 82 is erect from both ends, in the arrow BB' direction (the wiping direction), of the carriage bottom plate 81. The carriage side plates 82 are configured so as to be slidable relative to carriage support rails (unillustrated) in the printer main body 1. As shown in FIG. 14, on the top face of the carriage side plate 82, a rack portion 82*a* is formed. The rack portion 82*a* has rack teeth. The rack portion 82*a* meshes with a gear 85*a*. A gear train including the gear 85*a* couples to a carriage drive source (unillustrated motor). As the carriage drive source rotates forward and backward, the gear train rotates forward and backward. The carriage 80 can thus reciprocate between the first and second positions. The gear train including the gear 85*a* and the carriage drive source constitutes a unit horizontal-movement mechanism 85. The unit horizontal-movement mechanism 85 makes the cap unit 50 and the maintenance unit 19 move horizontally.

As shown in FIG. 14, a unit lift mechanism 60 is provided inside the carriage 80. The unit lift mechanism 60 raises and lowers the maintenance unit 19 in the up-down direction. The unit lift mechanism 60 includes wires 61*a* and 61*b*, a wind-up pulley 62, pulleys 63*a* and 63*b*, and a wind-up drive motor (wind-up drive source) 64. The wind-up pulley 62 winds up the wires 61*a* and 61*b*. The pulleys 63*a* and 63*b* change the direction of the wires 61*a* and 61*b*.

The wire 61*a* is stretched from the wind-up pulley 62 via the pulley 63*a* to be attached to a lower part of the maintenance unit 19 in the arrow A' direction. The wire 61*b* is stretched from the wind-up pulley 62 via the pulleys 63*a* and 63*b* to be attached to a lower part of the maintenance unit 19 in the arrow A direction. The wires 61*a* and 61*b*, the wind-up pulley 62, and the pulleys 63*a* and 63*b* are provided one each on either side (on each of the front and back sides of the plane of FIG. 14) in the arrow BB' direction (wiping direction). A pair of wind-up pulleys 62 is fixed at opposite ends of a rotary shaft 65. A rotary shaft gear (unillustrated) is fixed to the rotary shaft 65. The rotary shaft gear meshes with the gear in the gear train (unillustrated) which couples to the wind-up drive motor 64. As the wind-up drive motor 64 rotates forward and backward, the wind-up pulley 62 rotates forward and backward.

Figure 15:
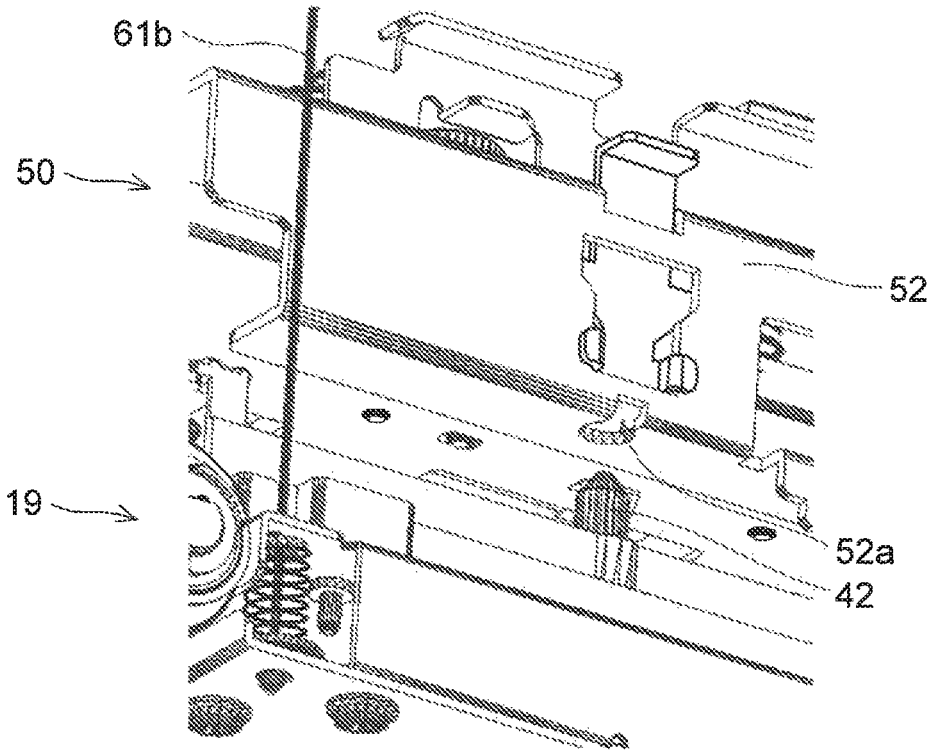
FIG. 15 is a diagram showing one example of a structure of and around a coupling pin and a push-up piece in the printer according to the one embodiment of the present disclosure in a state where the maintenance unit and the cap unit are not coupled together.

As shown in FIGS. 14 and 15, the maintenance unit 19 includes a plurality of coupling pins 42. The coupling pins 42 all point up. On the bottom face of the tray side plate 52 in the cap unit 50, there are formed coupling holes 52*a* (see FIG. 15). The positions of the coupling holes 52*a* correspond to the coupling pins 42. The coupling pins 42 and the coupling holes 52*a* constitute a coupling mechanism. The coupling mechanism couples and decouples the cap unit 50 and the maintenance unit 19 to and from each other.

Figure 16:
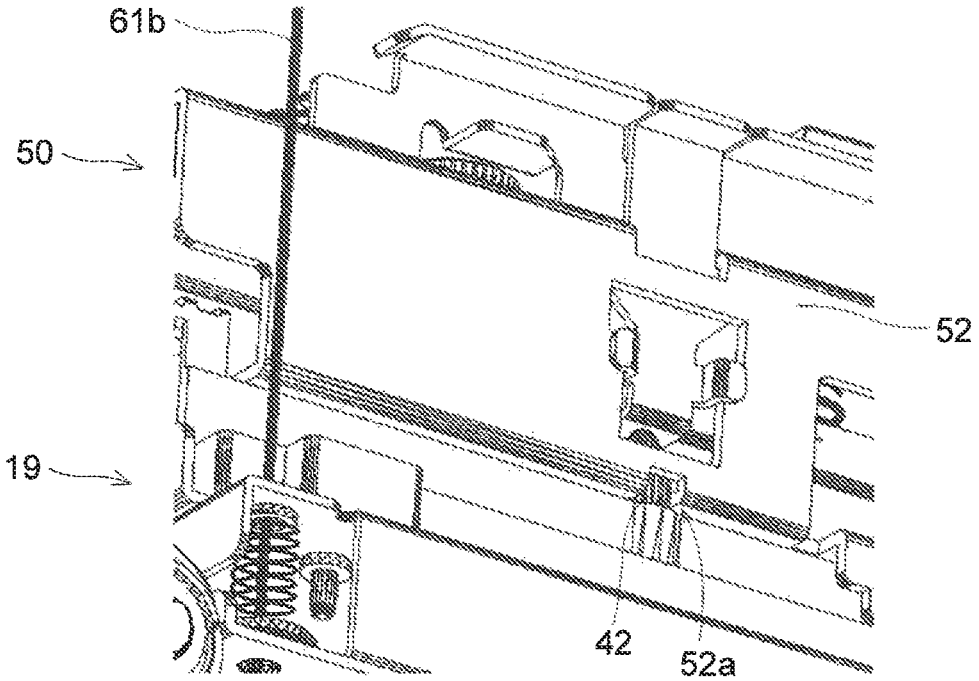
FIG. 16 is a diagram showing one example of the structure of and around the coupling pin and the push-up piece in the printer according to the one embodiment of the present disclosure in a state where the maintenance unit and the cap unit are coupled together.

When the maintenance unit 19 is lowered in the second position (the state in FIG. 14, the state arranged in a first height position), as shown in FIG. 15, the coupling pins 42 are not inserted in the coupling holes 52*a*. Thus, the maintenance unit 19 and the cap unit 50 are not coupled with each other (decoupled from each other). On the other hand, when the maintenance unit 19 in the second position is raised (arranged in a second height position higher than the first height position), as shown in FIG. 16, the coupling pins 42 are inserted in the coupling holes 52*a*. The maintenance unit 19 and the cap unit 50 are coupled with each other. As a result of the coupling, the cap unit 50 and the maintenance unit 19 are united. The cap unit 50 is now movable in the horizontal and up-down directions.

A cap supporting portion (unillustrated) is provided. The cap supporting portion supports the cap unit 50 in a decoupled state and in the second position. A lid member (unillustrated) is provided. The lid member, in a decoupled slate and except during capping operation, makes close contact with the cap portion 53 of the cap unit 50 in the second position. The lid member makes close contact with the cap portion 53 from above and protects the cap portion 53. The lid member prevents foreign matter (dust, paper powder, or the like) from sticking to the top face (face which makes close contact with the ink ejection face F) of the cap portion 53, and suppresses evaporation of moisture inside the cap portion 53.

Figure 17:
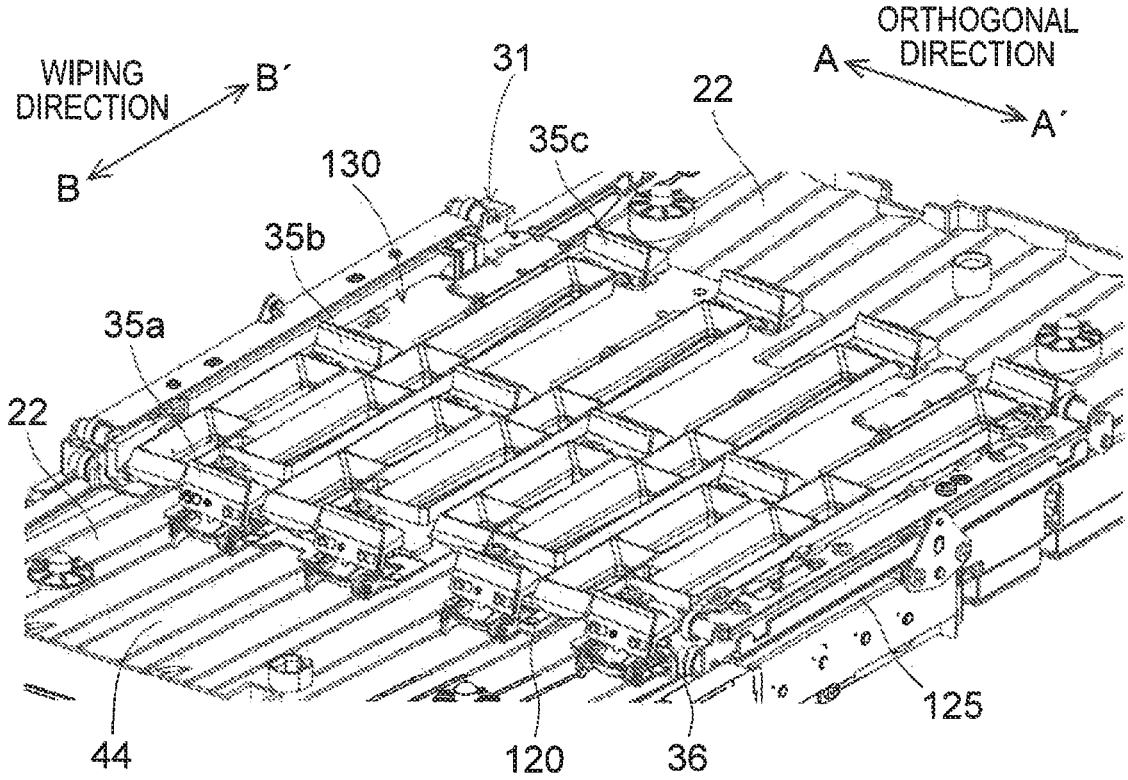
FIG. 17 is a diagram showing one example of a structure of and around the wiper carriage and the wiper unit of the maintenance unit according to the one embodiment of the present disclosure.
Figure 18:
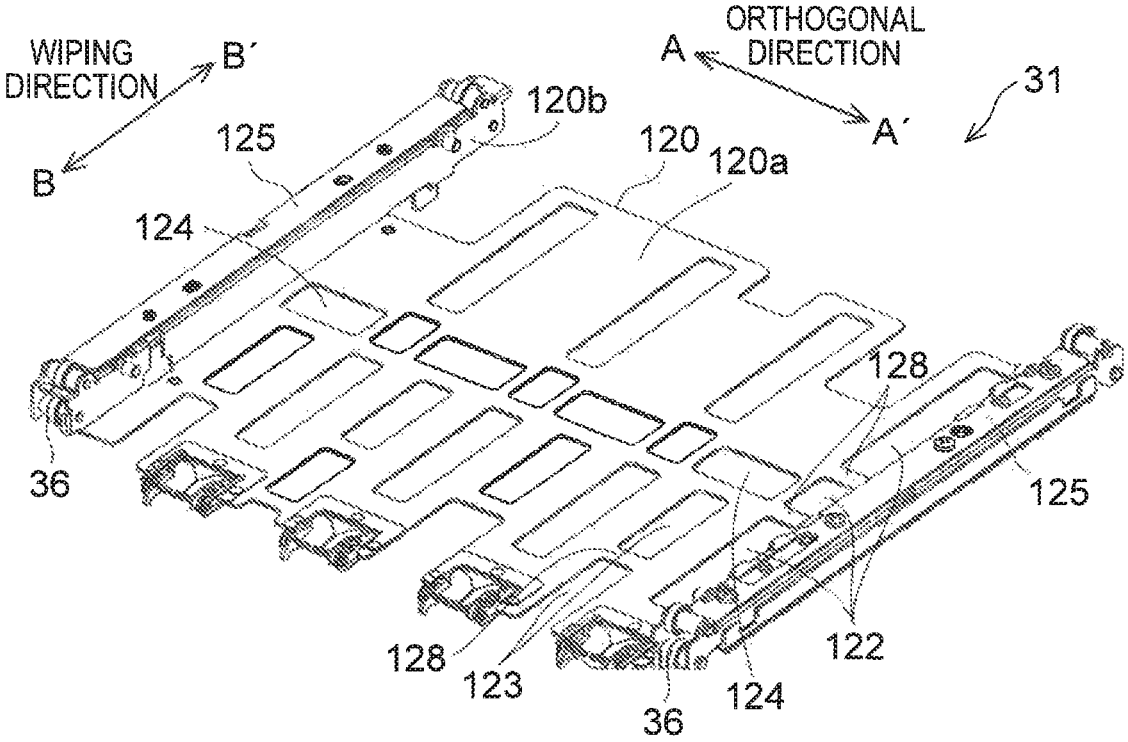
FIG. 18 is a diagram showing one example of the structure of the wiper carriage of the maintenance unit according to the one embodiment of the present disclosure.

Next, the structure around the wiper carriage 31 will be described in detail. As shown in FIGS. 17 and 18, the wiper carriage 31 includes a carriage main body 120 made of sheet metal and a pair of rail portions 125. Each rail portion 125 has a roller 36. As shown in FIG. 18, the carriage main body 120 has a bottom face portion 120*a* and side face portions 120*b*. The side face portions 120*b* are erect from end parts, in the arrow AA' direction (orthogonal direction perpendicular to the wiping direction), of the bottom face portion 120*a*. A pair of rail portions 125 is fixed to the side face portions 120*b*.

Figure 19:
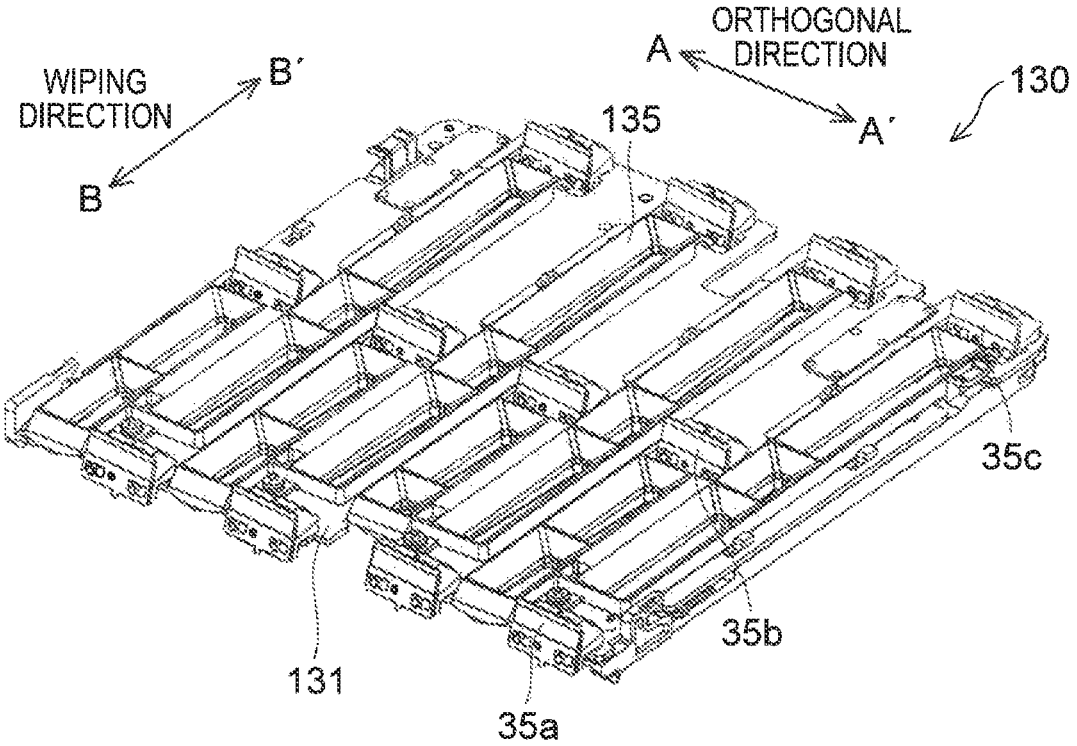
FIG. 19 is a diagram showing one example of the structure of the wiper unit of the maintenance unit according to the one embodiment of the present disclosure.

On the bottom face portion 120*a*, a wiper unit 130 shown in FIG. 19 is fixed. As shown in FIG. 19, the wiper unit 130 includes wipers 35*a* to 35*c*, a holding metal plate (holding plate) 131, and an ink guide member 135. The holding metal plate holds wipers 35*a* to 35*c*.

The holding metal plate 131 is arranged parallel to the bottom face portion 120*a* (see FIG. 18) of the carriage main body 120. The holding metal plate 131 is placed on the bottom face portion 120*a*. The holding metal plate 131 is, compared to the bottom face portion 120*a*, formed slightly shorter in the arrow AA' direction (orthogonal direction) and longer in the arrow BB' direction (wiping direction).

Figure 20:
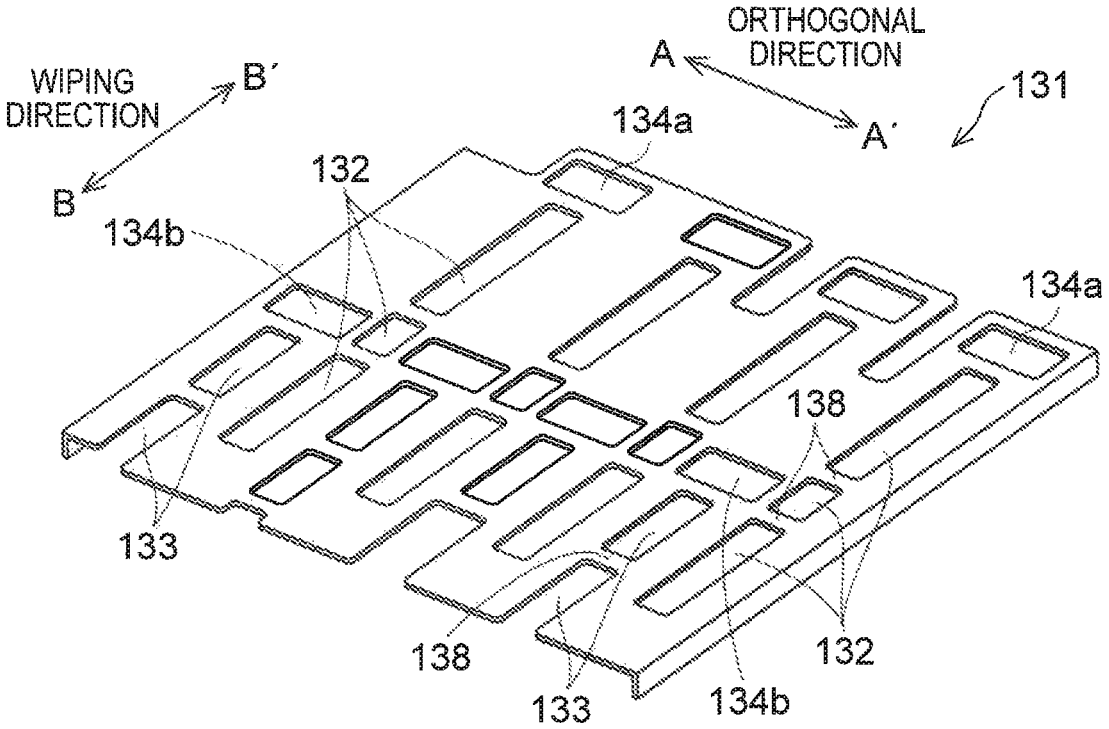
FIG. 20 is a diagram showing one example of a structure of a holding metal plate of the maintenance unit according to the one embodiment of the present disclosure.

As shown in FIG. 20, in the holding metal plate 131 in this embodiment, communication portions 132 and 133 are formed. The communication portions 132 and 133 connect together the upper space and the lower space. When purging, which will be described later, is started (that is, when the wiper carriage 31 is in the position in FIG. 12), the communication portions 132 and 133 are formed at parts facing (right under) the ink ejection face F of the recording heads 17*a* to 17*c* (see FIG. 3).

At the start of purging (when the wiper carriage 31 is in the position in FIG. 12, when the wiper carriage 31 is at the end in the arrow B' direction, when the wiper carriage 31 is at the end on one side in the wiping direction), the holding metal plate 131 is arranged right under the recording head 17*c*. The holding metal plate 131 is located right under the recording head 17*b* so as to overlap approximately one half of the recording head 17*b* on the arrow B'-direction side. The communication portion 132 of the holding metal plate 131 faces the ink ejection face F of the recording head 17*c*. A plurality of communication portions 132 are provided for one recording head 17*c*. FIG. 20 shows an example where three communication portions 132 are provided for each recording head 17*c* The communication portion 133 faces approximately one half of the recording head 17*b* on the arrow a'-direction side. A plurality of communication portions 133 are provided for one recording head 17*b*. FIG. 20 shows an example where two communication portions 133 are provided for each recording head 17*b*.

The wipers 35*c* are fitted farther to the arrow B'-direction side than the communication portion 132 farthest to the arrow B'-direction side (farthest to one side in the wiping direction) (see FIG. 19). The wipers 35*b* are fitted farther to the arrow B'-direction side than the communication portion 133 farthest to the arrow B'-direction side (farthest to one side in the orthogonal direction) (see FIG. 19). In the holding metal plate 131, ink passage holes 134*a* and 134*b* are formed. Through the ink passage holes 134*a*, ink wiped off by the wipers 35*c* passes downward. Through the ink passage holes 134*b*, ink wiped off by the wipers 35*b* passes downward.

On the bottom face portion 120*a* of the carriage main body 120, ink passage holes 124 corresponding to the ink passage holes 134*b* are formed. On the other hand, the ink passage holes 134*a* in the holding metal plate 131 are arranged farther to the arrow B' direction (farther to the one side in the wiping direction) than the bottom face portion 120*a* of the carriage main body 120. The bottom face portion 120*a* of the carriage main body 120 has no ink passage holes corresponding to the ink passage holes 134*a*.

Figure 21:
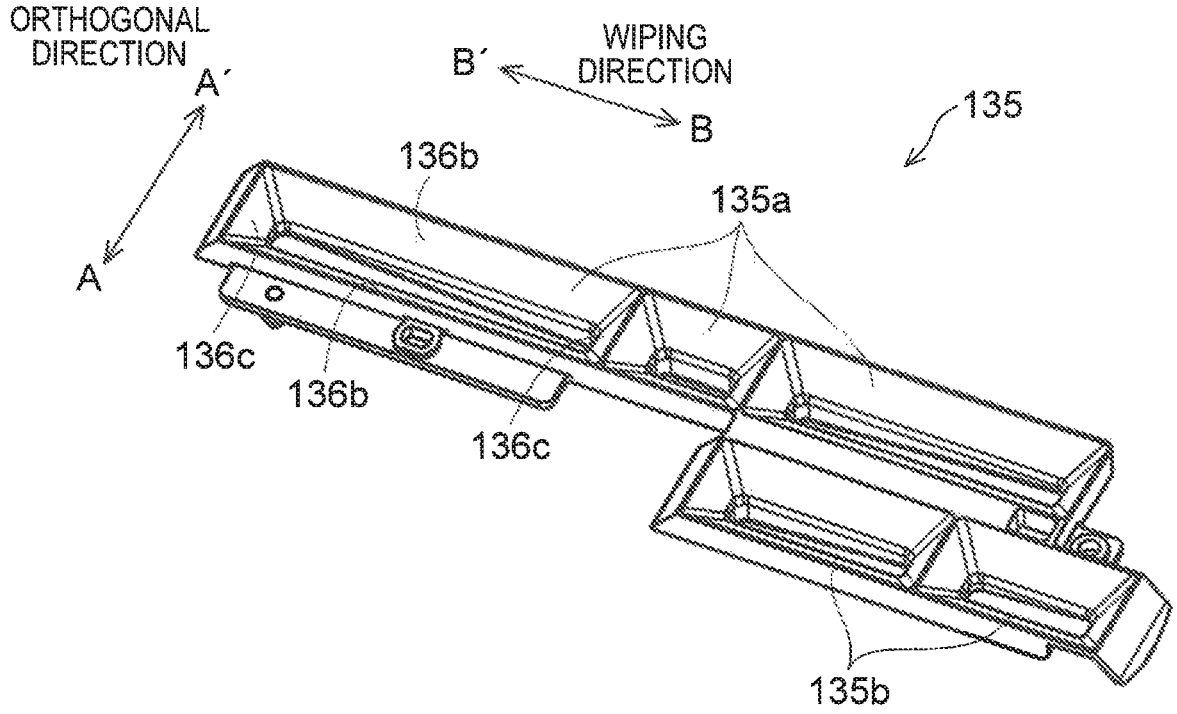
FIG. 21 is a diagram showing one example of a structure of an ink guide member of the maintenance unit according to the one embodiment of the present disclosure.

As shown in FIGS. 19 and 20, the ink guide members 135 are fixed to the holding metal plate 131 so as to cover the communication portions 132 and 133. The ink guide members 135 are fitted in the communication portions 132 and 133. As shown in FIG. 21, the ink guide member 135 includes guide portions 135*a* and 135*b*. The guide portions 135*a* correspond to the communication portions 132, The guide portions 135*b* correspond to the communication portions 133. FIGS. 19 and 21 show an example where the ink guide member 135 includes three guide portions 135*a* and two guide portions 135*b* The ink guide member 135 is integrally formed of resin.

Figure 22:
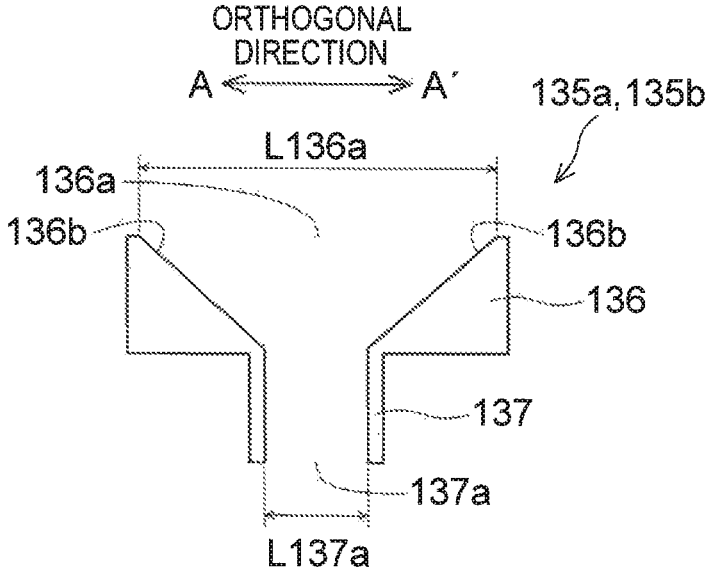
FIG. 22 is a diagram showing one example of a cross section of the ink guide member of the maintenance unit according to the one embodiment of the present disclosure cut along the arrow AA' direction.

As shown in FIG. 22, each of the guide portions 135*a* and 135*b* includes an ink receiving portion 136 and an ink guide portion 137. The ink receiving portion 136 includes an upper opening 136*a* (opens upward). The upper opening 136*a* receives ink which falls from the ink ejection face F when ink is forcibly pushed out of the ink ejection opening 18. In other words, ink falls from the ink ejection opening 18 into the upper opening 136*a*. The ink guide portion 137 extends from the lower end of the ink receiving portion 136 downward. The ink guide member 137 is inserted in one of the communication portion 132 or 133. In a lower end of the ink guide portion 137, a lower opening 137*a* is formed. Ink falls from the lower opening 137*a* onto the collection tray 44.

The ink receiving portion 136 has a pair of inclined faces 136*b* and a pair of inclined faces 136*c* (see FIG. 21). The pair of inclined faces 136*b* is arranged on opposite sides in the arrow AA' direction (orthogonal direction). The pair of inclined faces 136*b* is perpendicular to the arrow AA' direction. The pair of inclined faces 136*b* is increasingly close together downward. The length or the ink receiving portion 136 in the orthogonal direction is increasingly small downward. The pair of inclined faces 136*c* is arranged on opposite sides in the arrow BB' direction (wiping direction). The pair of inclined faces 136*c* is parallel to the arrow AA' direction. The pair of inclined faces 136*c* is increasingly close together. The length of the ink receiving portion 136 in the wiping direction is increasingly small downward. That is, the ink receiving portion 136 has a tapered shape. On the other hand, the ink guide portion 137 is formed such that its inner face extends in the vertical direction. The opening's inner area (ink passage area) is constant in the up-down direction.

Figure 23:
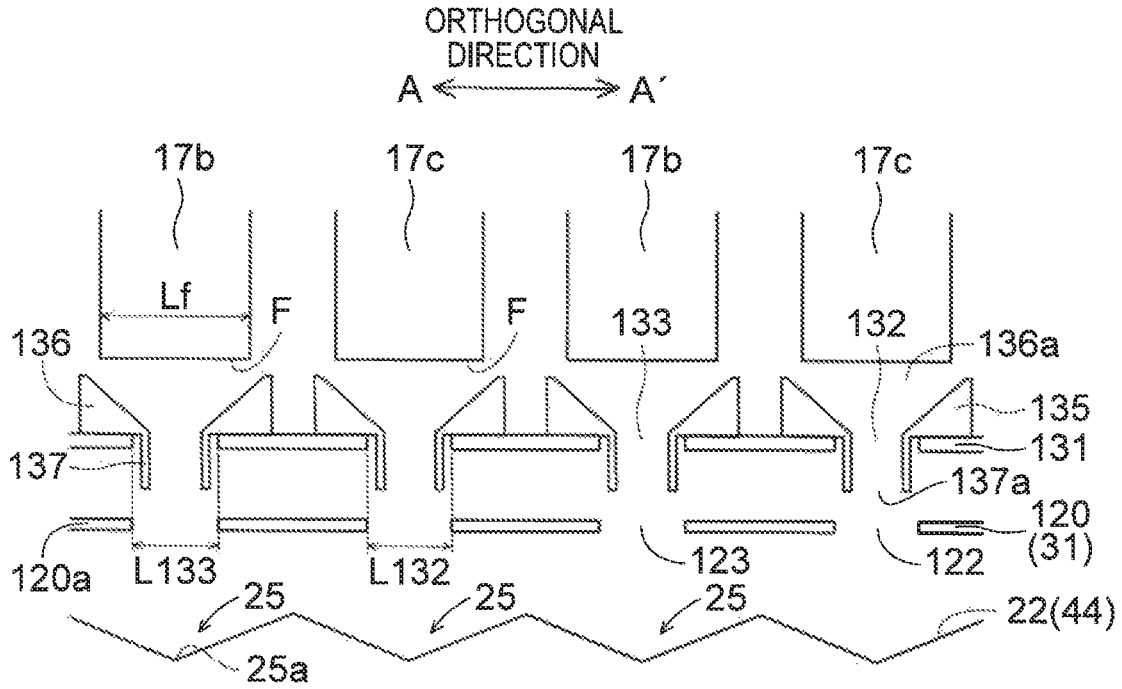
FIG. 23 is a diagram showing one example of a structure of and around the wiper carriage, the ink guide members, and the tray face of the maintenance unit according to the one embodiment of the present disclosure.

As shown in FIGS. 22 and 23, the length L136*a* of the upper opening 136*a* in the arrow AA' direction (orthogonal direction) is larger than the length Lf of the ink ejection face F in the arrow AA' direction. On the other hand, the length L137*a* of the lower opening 137*a* in the arrow AA' direction is smaller than the length Lf of the ink ejection face F in the arrow AA' direction. The length L132 (=L133) of the communication portions 132 and 133 in the arrow AA' direction is smaller than the length Lf of the ink ejection face F in the arrow AA' direction.

The length of the lower opening 137*a* in the arrow BB' direction (wiping direction) is smaller than the length of the upper opening 136*a* in the arrow BB' direction. Thus, as shown in FIG. 20, it is possible to provide bridging portions 138 between the communication portions 132 and between the communication portions 133 in the holding metal plate 131. The bridging portions 138 are unpunched-out parts of the holding metal plate 131 (unpenetrated parts in the up-down direction). Compared to in a case where large communication portions 132 and 133 with respect to the ink ejection face F are provided, it is possible to suppress degradation in strength of the holding metal plate 131.

As shown in FIGS. 18 and 20, in the bottom face portion 120*a* of the carriage main body 120 (see FIG. 18), the communication portions 122 and 123, the ink passage holes 124, and the bridging portions 128 are formed. The communication portions 122 and 123, the ink passage holes 124, and the bridging portions 128 are formed in the same sizes and at the same positions as (right under) the communication portions 132 and 133, the ink passage holes 134*b*, and the bridging portions 138 (see FIG. 20) of the holding metal plate 131.

Figure 24:
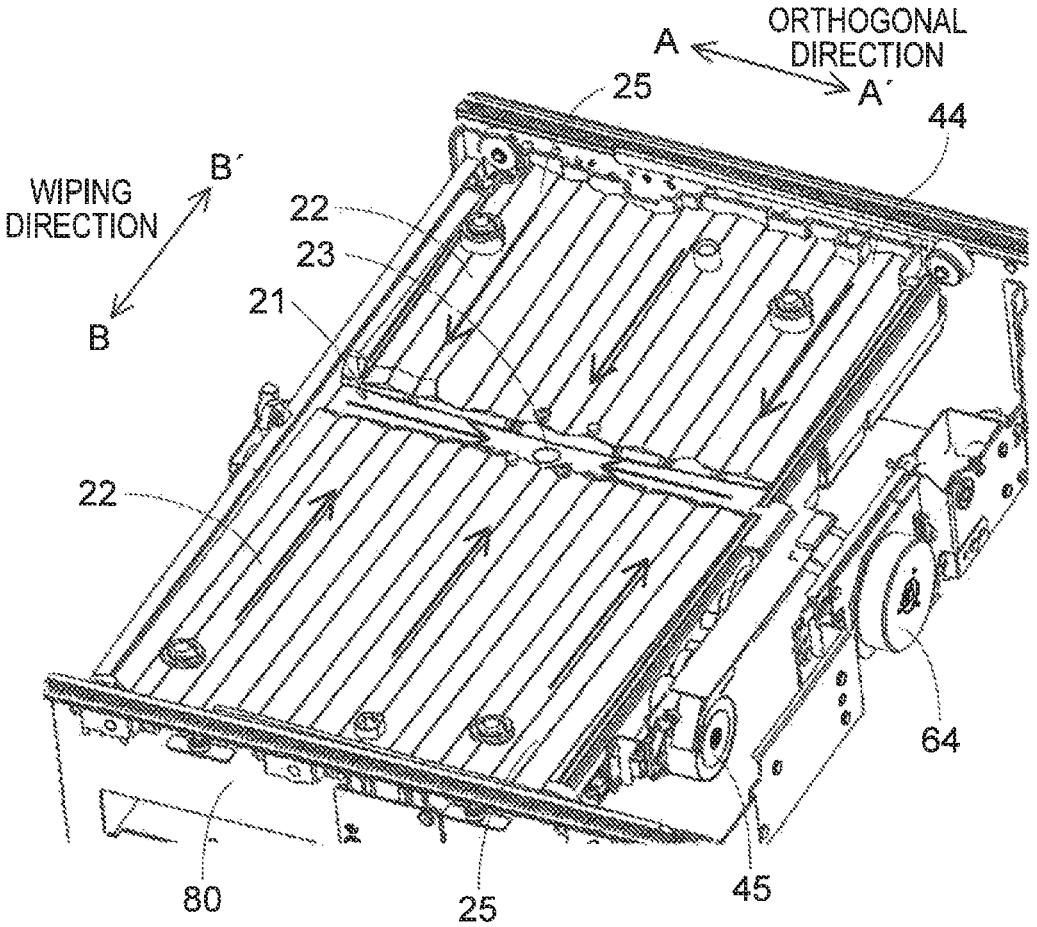
FIG. 24 is a diagram showing one example of a structure of and around a collection tray of the maintenance unit according to the one embodiment of the present disclosure.

Next, the structure of the collection tray 44 will be described. As shown in FIG. 17, the collection tray 44 is arranged under the wipers 35*a* to 35*c* (carriage main body 120). The collection tray 44 collects ink wiped off by the wipers 35*a* to 35*c*. As shown in FIG. 24, the top face of the collection tray 44 has a center groove 21 and a pair of tray faces 22. The center groove 21 is located in a central part in the arrow BB' direction (wiping direction) and extends in the arrow AA' direction (orthogonal direction). On both sides of the center groove 21 in the arrow BB' direction, the pair of tray faces 22 is arranged. The tray faces 22 are inclined downward toward the center groove 21. Ink fallen onto the tray faces 22 flows toward the center groove 21. The waste ink is thus collected.

The center groove 21 is formed so as to be inclined downward toward a central part in the arrow AA' direction (orthogonal direction). A discharge port 23 is arranged in the center groove 21. The discharge port 23 is arranged in the central part of the center groove 21 in the arrow AA' direction. The discharge port 23 discharges collected ink downward. To the discharge port 23, a discharge tube connected to a waste ink tank (none of these are illustrated) is connected. The ink fallen from the ink ejection face F onto the tray faces 22 flows on the tray faces 22 toward the center groove 21. Then, the ink on the center groove 21 flows toward the discharge port 23. Finally, the ink is discharged in the waste ink tank through the discharge port 23.

A plurality of grooves 25 are arranged in the tray faces 22, Each groove 25 extends in the arrow BB' direction (wiping direction). Each groove 25 is formed in a shape with a V-shaped cross section as seen from the arrow BB' direction. Ink fallen onto the tray faces 22 flows in the groove 25 toward the center groove 21.

As shown in FIG. 23, the grooves 25 are provided so as to correspond to the ink guide members 135. Each groove 25 is formed by a pair of inclined faces. The deepest portion 25*a* of the groove 25 faces the lower opening 137*a* of the ink guide member 135. The pitch of the grooves 25 as seen from the wiping direction (the arrow BB' direction) is equal to that of the lower openings 137*a*.

Next, recovery operation for the recording heads 17*a* to 17*c* in the printer 100 according to this embodiment will be described. The control portion 110 (see FIG. 1) controls recovery operation and capping operation which will be described below. The control portion 110 transmits a control signal. Based on the control signal, the control portion 110 controls operations of the recording heads 17*a* to 17*c*, the maintenance unit 19, the unit lift mechanism 60, the unit horizontal-movement mechanism 85, the conveying lift mechanism, different drive sources, and the like.

When recovery operation for the recording heads 17*a* to 17*c* is performed, the first conveying unit 5 facing the bottom face of the recording head 9 (see FIG. 1) is lowered from the state in FIG. 6 (see FIG. 7). Here, the maintenance unit 19 is arranged in the first height position. The maintenance unit 19 and the cap unit 50 are not coupled with each other.

Next, the carriage 80 is moved horizontally from the second position to the first position. As shown in FIG. 11, the cap unit 50 is left in the second position. The maintenance unit 19 in the first height position is moved horizontally from the second position to the first position.

As shown in FIG. 12, the unit lift mechanism 60 raises the maintenance unit 19. As a result, the wipers 35*a* to 35*c* in the maintenance unit 19 make contact with the wiping start positions of the ink ejection faces F of the corresponding recording heads 17*a* to 17*c*.

Prior to wiping operation, the recording heads 17*a* to 17*c* are supplied with ink. The supplied ink is pushed (purged) forcibly out of the ink ejection openings 18 (see FIG. 2). By this purging operation, thickened ink, foreign matter, and air bubbles inside the ejection openings 18 are discharged. The purged ink is pushed out to the ink ejection face F along the shape of the ink ejection region R (see FIG. 5).

The amount of ink forcibly pushed out of the ink ejection openings 18 changes according to the purpose. When a large amount of ink is forcibly pushed out, ink falls (spills) from the ink ejection face F. The ink fallen from the ink ejection face F fails onto the collection tray 44 via the ink guide member 135 or directly. The ink fallen on the ink guide member 135 is collected by the ink receiving portion 136 in the arrow AA' direction (orthogonal direction) and in the arrow BB' direction (wiping direction) and then falls on the collection tray 44.

After the ink is forcibly discharged, wiping operation in which ink (purged ink) on the ink ejection face F is wiped off is performed. Specifically, the wiper carriage moving motor 45 rotates forward from the state shown in FIG. 12. As shown in FIG. 13, the wiper carriage 31 moves horizontally in the arrow B direction (toward the other side of the wiping direction). The wipers 35*a* wipe off the ink on the ink ejection face F of the recording head 17*a*. The wipers 35*b* wipe off the ink on the ink ejection face F of the recording head 17*b*. The wipers 35*c* wipe off the ink on the ink ejection face F of the recording head 17*c*. The waste ink wiped off by the wipers 35*a* to 35*c* is collected in the ink collection tray 44.

Then, as shown in FIG. 11, the unit lift mechanism 60 (see FIG. 14) lowers the maintenance unit 19 down to the first height position. The wipers 35*a* to 35*c* move downward away from the ink ejection faces F of the recording heads 17*a* to 17*c*. Then, the control portion 110 makes the wiper carriage 31 move in the direction opposite to the wiping direction (the arrow B' direction, the one side of the wiping direction). The maintenance unit 19 returns to its original state.

Then, the control portion 110 makes the carriage 80 and the maintenance unit 19 move horizontally from the first position to the second position. The maintenance unit 19 is thereby positioned under the cap unit 50. Recovery operation for the recording heads 17*a* to 17*c* is finished.

Next, operation (capping operation) for attaching the cap unit 50 to the recording heads 17*a* to 17*c* in the printer 100 according to this embodiment will be described.

When the recording heads 17*a* to 17*c* are capped with the cap unit 50, the control portion 110 makes the first conveying unit 5 facing the bottom face of the recording portion 9 (see FIG. 1) descend (from the state in FIG. 6 to the state in FIG. 7). Here, the maintenance unit 19 is arranged in the first height position. The maintenance unit 19 and the cap unit 50 are not coupled with each other.

Then, the unit lift mechanism 60 (see FIG. 14) raises the maintenance unit 19 from the first height position to the second height position. As shown in FIG. 16, the maintenance unit 19 and the cap unit 50 are thereby coupled with each other.

Then, the control portion 110 makes the carriage 80 move horizontally from the second position to the first position (see FIG. 8). The cap unit 50, while remaining coupled with the maintenance unit 19, moves horizontally from the second position to the first position.

Then, the unit lift mechanism 60 makes the maintenance unit 19 and the cap unit 50 ascend (see FIG. 9). When the cap portion 53 makes close contact with the ink ejection faces F of the recording heads 17*a* to 17*c*, the control portion 110 makes the wind-up drive motor 64 (see FIG. 14) stop rotation. Capping is thus completed.

The maintenance unit 19 according to the embodiment is a maintenance unit 19 that cleans the recording heads 17*a* to 17*c* having an ink ejection face F in which ink ejection openings 18 for ejecting ink onto a recording medium (sheet P) are open. The maintenance unit 19 includes wipers 35*a* to 35*c*, a wiper carriage 31, and a collection tray 44. The wipers 35*a* to 35*c* wipe off ink on the ink ejection faces F. The wiper carriage 31, while holding the wipers 35*a* to 35*c*, moves along the wiping direction. The collection tray 44 has tray faces 22 arranged under the wipers 35*a* to 35*c*. The collection tray 44 collects ink wiped off by the wipers 35*a* to 35*c*. The wiper carriage 31 has a holding metal plate 131 (holding plate) for holding the wipers 35*a* to 35*c* and an ink guide members 135. In a part of the holding metal plate 131 (holding plate) facing the ink ejection face F, communication portions 132 and 133 which connect together the upper space and the lower space are formed. The ink guide member 135 has an upper opening 136*a* and a lower opening 137*a* connected to the upper opening 136*a*. The upper opening 136*a* receives ink fallen from the ink ejection face F and is arranged above the holding metal plate 131 (holding plate). The lower opening 137*a* is arranged in or under the communication portions 132 and 133 and above the tray faces 22. The length of the upper opening 136*a* in the orthogonal direction (AA' direction) which is perpendicular to the wiping direction is larger than the length Lf of the ink ejection face F in the orthogonal direction (AA' direction). The length L132 and L133 of the communication portions 132 and 133 in the orthogonal direction (arrow AA' direction) is smaller than the length Lf of the ink ejection face F in the orthogonal direction (arrow AA' direction). The length L137*a* of the lower opening 137*a* in the orthogonal direction (arrow AA' direction) is smaller than the length L132 and L133 of the communication portions 132 and 133 in the orthogonal direction (AA' direction).

Thus, even when the amount of ink pushed out of the ink ejection openings 18 is large, ink fallen from the ink ejection face F can be received with the ink guide members 135 without fail. It is possible to prevent ink from attaching to the holding metal plate 131. Thus, ink does not coagulate on the holding metal plate 131. Ink also does not flow to an end part of the wiper carriage 31 to affect the reciprocating movement of the wiper carriage 31.

The length L132 and L133 of the communication portions 132 and 133 in the arrow AA' direction (orthogonal direction) is smaller than the length Lf of the ink ejection face F in the arrow AA' direction. This prevents the communication portions 132 and 133 from having a large width in the arrow AA' direction. Degradation in strength of the holding metal plate 131 can thus be suppressed.

The length 137*a* of the lower opening 137*a* in the arrow AA' direction (orthogonal direction) is smaller than the length L136*a* of the upper opening 136*a* in the arrow AA' direction. It is possible to make ink fall onto the tray faces 22 while collecting it. This allows the ink fallen on the tray faces 22 to easily flow. This prevents ink from coagulating on the tray faces 22, Ink falls onto the tray faces 22 without spreading in the arrow AA' direction, and thus it is possible to prevent small amount of ink from being scattered on the tray faces 22. Ink flowability due to dispersion is not degraded and thus it is possible to prevent ink from coagulating.

The tray face 22 is inclined along the wiping direction. The tray face 22 has grooves extending along the wiping direction. The groove has a V-shaped cross section as seen from the wiping direction. The deepest portion of the groove faces the lower opening 137*a*. This allows ink fallen from the lower opening 137*a* to fall onto the deepest portion 25*a* of the groove 25. This makes ink flow smoothly in the groove 25.

The length of the lower opening 137*a* in the wiping direction (arrow BB' direction) is smaller than the length of the upper opening 136*a* in the wiping direction. This prevents the communication portions 132 and 133 from having a large width in the arrow BB' direction. Degradation in strength of the holding metal plate 131 can thus be suppressed. Ink collected also in the arrow BB' direction falls on the tray faces 22. This allows the ink fallen on the tray faces 22 to easily flow.

A plurality of upper openings 136*a* and a plurality of communication portions 132 and 133 are provided for one ink ejection face F. On the holding metal plate 131 (holding plate), the bridging portions 138 are provided between a plurality of communication portions 132 and 133 for one ink ejection face F. The bridging portions 138 are the unpenetrated parts. The bridging portion 138 can be provided between the communication portions 132 corresponding to one ink ejection face F and between the communication portions 133 corresponding to one ink ejection face F. In this way, it is possible to make the size of each communication portion 132 and 133 small. Degradation in strength of the holding metal plate 131 can thus be suppressed.

The ink guide members 135 includes an ink receiving portion 136 and an ink guide portion 137. The ink receiving portion 136 has an upper opening 136*a* and its length in the orthogonal direction (AA' direction) is increasingly small downward. The ink guide portion 137 has a lower opening 137*a*, extends from the lower end of the ink receiving portion 136 downward, and is inserted in the communication portions 132 and 133. It is possible to prevent ink fallen from the ink ejection face F from attaching to the holding metal plate 131. It is also possible to make ink fail on the collection tray 44.

The length of the ink receiving portion 136 is increasingly small downward in the wiping direction.

It should be understood that the embodiments disclosed herein are in every aspect illustrative and not restrictive. The scope of the present disclosure is not limited by the description of the embodiments given above but by the appended claims, and encompasses any modifications made within a sense and scope equivalent to those of the claims.

For example, the above embodiments deal with an example where a plurality of communication portions 132 and 133 are provided in each ink ejection face F. Instead, one each of the communication portions 132 and 133 may be provided for each ink ejection face F.

The above embodiments also deal with an example where the holding metal plate (holding plate) 131 is provided on the bottom face portion 120*a* of the carriage main body 120 and the ink guide members 135 are provided on the holding metal plate 131. However, this is not meant to limit the present disclosure. For example, with no holding metal plate 131 provided, the wipers 35*a* to 35*c* may be fixed to the bottom face portion 120*a* of the carriage main body 120. The ink guide members 135 may be provided on the bottom face portion 120*a*, in this case, the bottom face portion 120*a* of the carriage main body 120 corresponds to the "holding plate" according to the present disclosure.

The above embodiments deal with an example where the grooves 25 with the V shape cross section are formed on the tray faces 22. This is in no way meant to limit the present disclosure. The tray faces 22 do not necessarily need to have grooves 25 formed in it.

What is claimed is:

1. A maintenance unit which cleans a recording head having an ink ejection face in which ink ejection openings for ejecting ink onto a recording medium are open, comprising:

a wiper for wiping off ink on the ink ejection face;

a wiper carriage which, while holding the wiper, moves along a wiping direction; and a collection tray which has a tray face arranged under the wiper and which collects the ink wiped off by the wiper, wherein the wiper carriage has a holding plate for holding the wiper and an ink guide member, in a part of the holding plate fading the ink ejection face, a communication portion which connects together an upper space and a lower space is formed, the ink guide member has an upper opening and a lower opening connected to the upper opening, the upper opening receives the ink fallen from the ink ejection face and is arranged above the holding plate, the lower opening is arranged in or under the communication portion and above the tray face, a length of the upper opening in an orthogonal direction perpendicular to the wiping direction is larger than a length of the ink ejection face in the orthogonal direction, a length of the communication portion in the orthogonal direction is smaller than the length of the ink ejection face in the orthogonal direction, and a length of the lower opening in the orthogonal direction is smaller than the length of the communication portion in the orthogonal direction.

2. The maintenance unit according to claim 1, wherein the tray face is inclined along the wiping direction, the tray face has a groove which extends along the wiping direction, and a deepest portion of the groove faces the lower opening.

3. The maintenance unit according to claim 1, wherein a length of the lower opening in the wiping direction is smaller than a length of the upper opening in the wiping direction.

4. The maintenance unit according to claim 3, wherein a plurality of the upper openings and a plurality of the communication portions are provided for one ink ejection face.

5. The maintenance unit according to claim 4, wherein a bridging portion is provided on the holding plate between the plurality of communication portions for one ink ejection face, and the bridging portion is an unpenetrated part.

6. The maintenance unit according to claim 1, wherein the ink guide member includes an ink receiving portion and an ink guide portion, the ink receiving portion has the upper opening and a length of the ink receiving portion in the orthogonal direction is increasingly small downward, and the ink guide portion has the lower opening, extends from a lower end of the ink receiving portion downward, and is inserted in the communication portion.

7. The maintenance unit according to claim 6, wherein the length of the ink receiving portion in the wiping direction is increasingly small downward.

8. An ink-jet recording apparatus comprising:

the maintenance unit according to claim 1; and the recording head which ejects the ink on the recording medium.

* * * * *